US010563291B2

(12) United States Patent
Tofail et al.

(10) Patent No.: US 10,563,291 B2
(45) Date of Patent: Feb. 18, 2020

(54) METHOD OF FORMING A SINTERED NICKEL-TITANIUM-RARE EARTH (NI—TI—RE) ALLOY

(71) Applicant: University of Limerick, Limerick (IE)

(72) Inventors: Syed Ansar Md. Tofail, Limerick (IE); James Butler, Aherlow (IE)

(73) Assignee: University of Limerick, Limerick (IE)

( * ) Notice: Subject to any disclaimer, the term of this patent is extended or adjusted under 35 U.S.C. 154(b) by 0 days.

(21) Appl. No.: 15/978,921

(22) Filed: May 14, 2018

(65) Prior Publication Data

US 2018/0291481 A1 Oct. 11, 2018

Related U.S. Application Data

(62) Division of application No. 13/656,151, filed on Oct. 19, 2012, now Pat. No. 10,000,827.

(30) Foreign Application Priority Data

Oct. 21, 2011 (GB) ..... 1118208.6

(51) Int. Cl.

| | |
|---|---|
| ***B22F 3/105*** | (2006.01) |
| ***B22F 3/12*** | (2006.01) |
| ***B22F 3/24*** | (2006.01) |
| ***B32B 15/02*** | (2006.01) |
| ***C22C 19/00*** | (2006.01) |
| ***C22C 1/04*** | (2006.01) |
| ***C22C 19/03*** | (2006.01) |

(52) U.S. Cl.

CPC ..... *C22C 19/007* (2013.01); *B22F 3/105* (2013.01); *C22C 1/0433* (2013.01); *C22C 1/0441* (2013.01); *C22C 19/03* (2013.01)

(58) Field of Classification Search

CPC ..... B22F 3/105; C22C 19/00; C22C 19/0433

See application file for complete search history.

(56) References Cited

U.S. PATENT DOCUMENTS

| | | | |
|---|---|---|---|
| 5,069,226 | A | 12/1991 | Yamauchi et al. |
| 5,230,348 | A | 7/1993 | Ishibe et al. |
| 5,636,641 | A | 6/1997 | Fariabi |

(Continued)

FOREIGN PATENT DOCUMENTS

| | | |
|---|---|---|
| CN | 101314826 | 12/2008 |
| DE | 10 2007 047 522 A1 | 4/2009 |

(Continued)

OTHER PUBLICATIONS

US 5,976,281 A, 11/1999, Nakamura et al. (withdrawn)

(Continued)

*Primary Examiner* — Colleen P Dunn
*Assistant Examiner* — Jeremy C Jones
(74) *Attorney, Agent, or Firm* — Brinks Gilson & Lione

(57) ABSTRACT

A method of forming a sintered nickel-titanium-rare earth (Ni—Ti-RE) alloy includes adding one or more powders comprising Ni, Ti, and a rare earth constituent to a powder consolidation unit comprising an electrically conductive die and punch connectable to a power supply. The one or more powders are heated at a ramp rate of about 35° C./min or less to a sintering temperature, and pressure is applied to the powders at the sintering temperature, thereby forming a sintered Ni—Ti-RE alloy.

17 Claims, 14 Drawing Sheets

(56) References Cited

U.S. PATENT DOCUMENTS

| | | | |
|---|---|---|---|
| 5,637,089 | A | 6/1997 | Abrams et al. |
| 5,641,364 | A | 6/1997 | Golberg et al. |
| 5,885,381 | A | 3/1999 | Mitose et al. |
| 5,927,345 | A | 7/1999 | Samson |
| 5,951,793 | A | 9/1999 | Mitose et al. |
| 5,964,968 | A | 10/1999 | Kaneko |
| 6,165,292 | A | 12/2000 | Abrams et al. |
| 6,277,084 | B1 | 8/2001 | Abele et al. |
| 6,312,454 | B1 | 11/2001 | Stöckel et al. |
| 6,312,455 | B2 | 11/2001 | Duerig et al. |
| 6,325,824 | B2 | 12/2001 | Limon |
| 6,352,515 | B1 | 3/2002 | Anderson et al. |
| 6,375,458 | B1 | 4/2002 | Moorleghem et al. |
| 6,379,380 | B1 | 4/2002 | Satz |
| 6,399,886 | B1 | 6/2002 | Avellanet |
| 6,461,453 | B1 | 10/2002 | Abrams et al. |
| 6,482,166 | B1 | 11/2002 | Fariabi |
| 6,497,709 | B1 | 12/2002 | Heath |
| 6,557,993 | B2 | 5/2003 | Rossin |
| 6,569,194 | B1 | 5/2003 | Pelton |
| 6,572,646 | B1 | 6/2003 | Boylan et al. |
| 6,602,228 | B2 | 8/2003 | Nanis et al. |
| 6,626,937 | B1 | 9/2003 | Cox |
| 6,682,608 | B2 | 1/2004 | Abrams |
| 6,706,053 | B1 | 3/2004 | Boylan et al. |
| 6,776,795 | B2 | 8/2004 | Pelton |
| 6,827,734 | B2 | 12/2004 | Fariabi |
| 6,830,638 | B2 | 12/2004 | Boylan et al. |
| 6,855,161 | B2 | 2/2005 | Boylan et al. |
| 6,884,234 | B2 | 4/2005 | Aita et al. |
| 7,128,757 | B2 | 10/2006 | Boylan et al. |
| 7,192,496 | B2 | 3/2007 | Wojcik |
| 7,244,319 | B2 | 7/2007 | Abrams et al. |
| 7,258,753 | B2 | 8/2007 | Abrams et al. |
| 7,462,192 | B2 | 12/2008 | Norton et al. |
| 7,641,983 | B2 | 1/2010 | Stinson |
| 2001/0047185 | A1 | 11/2001 | Satz |
| 2002/0082681 | A1 | 6/2002 | Boylan et al. |
| 2003/0120181 | A1 | 6/2003 | Toma et al. |
| 2004/0143317 | A1 | 7/2004 | Stinson et al. |
| 2004/0220608 | A1 | 11/2004 | D'Aquanni et al. |
| 2004/0236409 | A1 | 11/2004 | Pelton et al. |
| 2004/0249447 | A1 | 12/2004 | Boylan et al. |
| 2005/0038500 | A1 | 2/2005 | Boylan et al. |
| 2005/0131522 | A1 | 6/2005 | Stinson et al. |
| 2005/0209683 | A1 | 9/2005 | Yamauchi et al. |
| 2006/0129166 | A1 | 6/2006 | Lavelle |
| 2006/0222844 | A1 | 10/2006 | Stinson |
| 2007/0183921 | A1 | 8/2007 | Furuya et al. |
| 2007/0249965 | A1 | 10/2007 | Abrams et al. |
| 2008/0053577 | A1 | 3/2008 | Syed et al. |
| 2008/0114449 | A1 | 5/2008 | Gregorich et al. |
| 2009/0018644 | A1 | 1/2009 | Weber et al. |
| 2009/0162243 | A1* | 6/2009 | Diamant ..... A61L 29/02 420/580 |
| 2009/0165898 | A1* | 7/2009 | Wong ..... A61L 31/022 148/402 |
| 2010/0310407 | A1 | 12/2010 | Koehl et al. |
| 2011/0114230 | A1 | 5/2011 | Syed et al. |
| 2011/0137398 | A1 | 6/2011 | Magnuson et al. |
| 2012/0315178 | A1 | 12/2012 | Al-Sudani et al. |

FOREIGN PATENT DOCUMENTS

| | | | |
|---|---|---|---|
| EP | 0873734 | A2 | 10/1998 |
| JP | 48 066521 | A | 9/1973 |
| JP | 58 157935 | A | 9/1983 |
| JP | 59 104459 | A2 | 6/1984 |
| JP | 60-262929 | | 12/1985 |
| JP | 61 210142 | A2 | 9/1986 |
| JP | 62 007839 | A2 | 1/1987 |
| JP | 62-164802 | | 7/1987 |
| JP | 04009406 | A | 1/1992 |
| JP | 9-137241 | | 5/1997 |
| JP | 9-263913 | | 10/1997 |
| JP | 09263913 | A | 10/1997 |
| JP | 10046208 | A | 2/1998 |
| JP | 2011-519595 | | 7/2011 |
| WO | WO 01/72349 | A1 | 10/2001 |
| WO | WO 02/051462 | A2 | 7/2002 |
| WO | WO 03/088805 | A2 | 10/2003 |
| WO | WO 2004/033016 | A1 | 4/2004 |
| WO | WO 2006/081011 | A2 | 8/2006 |
| WO | WO 2009/070784 | A1 | 6/2009 |
| WO | WO 2013/057292 | A1 | 4/2013 |

OTHER PUBLICATIONS

"Biological Evaluation of Medical Devices—Part 1: Evaluation and Testing," *American National Standard ANSI/AAMI/ISO 10993-1:2003*, Association for the Advancement of Medical Instrumentation (AAMI), Arlington, VA, USA, 2003, 25 pages.

"Radiopaque Polymers," *Encyclopedia of Polymer Science and Engineering*, John Wiley & Sons, Inc., New York, USA, 1988, 14, pp. 1-8 (10 pages).

"Standard Practice for Direct Contact Cell Culture Evaluation of Materials for Medical Devices," *American Society for Testing and Materials (ASTM) Standard F813-01*, ASTM International, West Conshohocken, PA, 2001, 4 pages.

"Standard Practice for Selecting Generic Biological Test Methods for Materials and Devices," *American Society for Testing and Materials (ASTM) Standard F748-04*, ASTM International, West Conshohocken, PA, 2004, 1 page.

"Standard Specification for Wrought Nickel-Titanium Shape Memory Alloys for Medical Devices and Surgical Implants," *American Society for Testing and Materials (ASTM) Standard F2063-05*, ASTM International, West Conshohocken, PA, 2005, 4 pages.

"Standard Test Method for Agar Diffusion Cell Culture Screening for Cytotoxicity," *American Society for Testing and Materials (ASTM) Standard F895-84*, ASTM International, West Conshohocken, PA, 2006, 5 pages.

"Standard Test Method for Tension Testing of Nickel-Titanium Superelastic Materials," *American Society for Testing and Materials (ASTM) Standard F251607*, ASTM International, West Conshohocken, PA, 2007, 6 pages.

"Standard Test Method for Transformation Temperature of Nickel-Titanium Alloys by Thermal Analysis," *American Society for Testing and Materials (ASTM) Standard F2004-05*, ASTM International, West Conshohocken, PA, 2005, 4 pages.

"μ-MIM: Making the Most of NiTi," Metal Powder Report 63, 5 (2008) pp. 21-24.

Aichinger, H.; Dierker, J.; Joite-Barfuß, S.; Säbel, M. "Raw X-Ray Data for Unfiltered Photons," *Radiation Exposure and Image Quality in X-Ray Diagnostic Radiology: Physical Principles and Clinical Applications*, Springer, Berlin.

Bertheville, B. et al., "Alternative Powder Metallurgical Processing of Ti-rich NiTi Shape-Memory Alloys," *Scripta Materialia*, 52 (2005) pp. 507-512.

Boriskina, N.G.; Kenina, E.M. "Phase Equilibria in the Ti—TiPd—TiNi System Alloys," *Titanium '80, Science and Technology, Proceedings of the 4th International Conference on Titanium*, Kumura, H. and Izumi O., eds., 1980, The Metallurgical Society of AIME, Warrendale, PA, pp. 2917-2927.

Bozzolo, G.; Noebe, R.D.; Mosca, H.O. "Atomistic Modeling of Pd Site Preference in NiTi," *Journal of Alloys and Compounds*, 2005, 386, pp. 125-138.

Bram, M. et al., "Powder Metallurgical Fabrication Processes for NiTi Shape Memory Alloy Parts," *Materials Science and Engineering*, A337 (2002) pp. 254-263.

Cai, W.; Tanaka, S.; Otsuka, K. "Thermal Cyclic Characteristics Under Load in a $Ti_{50.6}Pd_{30}$ $T_{19.4}$ Alloy," *Materials Science Forum*, 2000, 327-328, pp. 279-282.

Cai, W.; Zhao, L. "The Reverse Transformation of Deformation-Induced Martensite in a Ni—Ti—Nb Shape Memory Alloy with Wide Hysteresis," *Shape Memory Materials'94 Proceedings of the International Symposium on Shape Memory Materials*, 1994, International Academic Publishers, pp. 235-238 (5 pages).

(56) References Cited

OTHER PUBLICATIONS

Chen J.T. et al., "An Apparatus to Measure the Shape Memory Properties of Nitinol Tubes for Medical Applications," *Journal De Physique IV*, Coll C8, 5, (1995) pp. 1247-1252.
Chinese Office Action dated Feb. 25, 2016, for Chinese Patent Application No. 201280051386.8 (translated), 5 pages.
Chinese Office Action dated Oct. 8, 2015, for Chinese Patent Application No. 201280051386.8 (translated), 11 pages.
Combined Search and Examination Report for UK Patent Application No. GB1118208.6 dated Feb. 10, 2012, 4 pages.
International Preliminary Report on Patentability for International Patent Application No. PCT/US2007/019445 dated Dec. 4, 2008.
International Search Report and the Written Opinion for International Patent Application No. PCT/US2007/019445 dated Dec. 14, 2007.
International Search Report and the Written Opinion for International Patent Application No. PCT/US2010/056687 dated Jan. 19, 2011.
Craig, C.; Friend, C.; Edwards, M.; Gokcen, N. "Tailoring Radiopacity of Austenitic Stainless Steel for Coronary Stents," *Proceedings from the Materials & Processes for Medical Devices Conference*, Sep. 8-10, 2003, ASM International, Anaheim, CA, 2004, pp. 294-297.
Di, J.; Wenxi, L.; Ming, H.; Defa, W.; Zhizhong, D. "Some Properties of Ni—Ti—Nb—X Quarternary Alloys," *Z. Metallkd.*, 2000, 91(3), pp. 258-260.
Donkersloot, H.C.; Van Vucht, J.H.N. "Martensitic Transformations in Gold-Titanium, Palladium-Titanium and Platinum-Titanium Alloys Near the Equiatomic Composition," *Journal of the Less-Common Metals*, 1970, 20, pp. 83-91.
Eckelmeyer, K.H. "The Effect of Alloying on the Shape Memory Phenomenon in Nitinol," *Scripta Metallurgica*, 1976, 10, pp. 667-672.
Enami, K.; Hara, M.; Maeda, H. "Effect of W Addition on the Martensitic Transformation and Shape Memory Behaviour of the TiNi-Base Alloys," *Journal de Physique IV*, 1995, 5, pp. C8-629-C8-633.
Enami, K.; Yoshida, T.; Nenno, S. "Premartensitic and Martensitic Transformations in TiPd—Fe Alloys," *Proceedings of the International Conference on Martensitic Transformations*, The Japan Institute of Metals, 1986, pp. 103-108.
Examination and Search Report for UK Patent Application No. GB118208.6 dated Nov. 23, 2012, 3 pp.
Examination Report for UK Patent Application No. GB1118208.6 dated Feb. 21, 2013, 1 page.
Fourth Office Action (translated) dated Dec. 2, 2016, issued by the State Intellectual Property Office of P.R. China for Chinese Patent Application No. 201280051386.8, 3 pages.
Frenzel, J. et al., "High Quality Vacuum Induction Melting of Small Quantities of NiTi Shape Memory Alloys in Graphite Crucibles," *Journal of Alloys and Compounds*, 385 (2004) pp. 214-223.
Fu, Y.Q. et al., "Spark Plasma Sintering of TiNi Nano-Powders for Biological Application," *Nanotechnology*, 17 (2006) pp. 5293-5298.
Golberg, D.; Xu, Y.; Murakami, Y.; Otsuka, K.; Ueki, T.; Horikawa, H. "High-Temperature Shape Memory Effect in $Ti_{50}Pd_{50-x}Ni_x$ (X=10, 15, 20) Alloys," *Materials Letters*, 1995, 22, pp. 241-248.
Gschneidner Jr., K.; Russell, A.; Pecharsky, A.; Morris, J.; Zhang, Z.; Lograsso, T.; Hsu, D.; Chester Lo, C.H.; Ye, Y.; Slager, A.; Kesse, D. "A Family of Ductile Intermetallic Compounds," *Nature Materials*, 2003, 2, pp. 587-590.
Gupta, K.P. "The Hf—Ni—Ti (Hafnium-Nickel-Titanium) System," *Journal of Phase Equilibria*, 2001, 22(1), pp. 69-72.
Hashi, K.; Ishikawa, K.; Matsuda, T.; Aoki, K. "Hydrogen Permeation Characteristics of Multi-Phase Ni—Ti—Nb Alloys," *Journal of Alloys and Compounds*, 2004, 368, pp. 215-220.
Hashi, K.; Ishikawa, K.; Matsuda, T.; Aoki, K. "Hydrogen Permeation of Ternary Ni—Ti—Nb Alloys," *Advanced Materials for Energy Conversion II*, 2004, TMS (The Minerals, Metals & Materials Society), Warrendale, PA, pp. 283-289.
Haxel, G.B.; Hedrick, J.B.; Orris, G.J. "Rare Earth Elements—Critical Resources for High Technology," USGS Fact Sheet 087-02, U.S. Dept. of the Interior, 2002, 4 pages.
Hodgson, D.E.; Brown, J.W. *Using Nitinol Alloys*, Shape Memory Applications, Inc., San Jose, CA, 2000, 52 pages.
Hosoda, H.; Tsuji, M.; Takahashi, Y.; Inamura, T.; Wakashima, K.; Yamabe-Mitarai, Y.; Miyazaki, S.; Inoue, K. "Phase Stability and Mechanical Properties of Ti—Ni Shape Memory Alloys containing Platinum Group Metals," *Materials Science Forum*, 2003, 426-432, pp. 2333-2338.
Huang, X.; Lei Y.; Huang, B.; Chen, S.; Hsu, T.Y. "Effect of Rare-Earth Addition on the Shape Memory Behavior of a FeMnSiCr Alloy," *Materials Letters*, 2003, 57, pp. 2787-2791.
Huisman-Kleinherenbrink, P.M.; Beyer, J. "The Influence of Ternary Additions on the Transformation Temperatures of NiTi Shape Memory Alloys—A Theoretical Approach," *Journal de Physique IV*, 1991, 1, pp. C4-47-C4-52.
International Preliminary Report on Patentability for International Patent Application No. PCT/EP2012/070818 dated Apr. 24, 2014, 6 pp.
International Search Report and Written Opinion for International Patent Application No. PCT/EP2012/070818 dated Jan. 23, 2013, 8 pp.
Japanese Office Action for Japanese Patent Application No. 2011-506295, dated Jun. 10, 2014, pp. 1-2.
Jingqi, L. et al., "Isothermal Section of the Phase Diagram of the Ternary System Dy—Ni—Ti at 773 K," *Journal of Alloys and Compounds*, 313 (2000) pp. 93-94.
Jingqi, L. et al., "The 773 K Isothermal Section of the Ternary Phase Diagram of the Nd—Ni—Ti," *Journal of Alloys and Compounds*, 368 (2004) pp. 180-181.
Jingqi, L. et al., "The Isothermal Section of the Phase Diagram of the La—Ni—Ti Ternary System at 673 K," *Journal of Alloys and Compounds*, 312 (2000) pp. 121-123.
Jung, J.; Ghosh, G.; Olson, G.B. "A Comparative Study of Preciptiation Behavior of Heusler Phase ($Ni_2TiAl$) from B2—TiNi in Ni—Ti—Al and Ni—Ti—Al—X (X=Hf, Pd, Pt, Zr) Alloys," *Acta Materialia*, 2003, 51, pp. 6341-6357.
Kattner, U.R. "Thermodynamic Modeling of Multicomponent Phase Equilibria," *Journal of Metals* (*JOM*), 1997, 49(12), pp. 14-19.
Khachin, V.N.; Gjunter, V.E.; Sivokha, V.P.; Savvinov, A.S. "Lattice Instability, Martensitic Transformations, Plasticity and Anelasticity of TiNi," *Proc. ICOMAT*, 1979, 79, pp. 474-479.
Khachin, V.N.; Matveeva, N.M.; Sivokha, V.P.; Chernov, D.B.; Kovneristyi, Y.K. "High-Temperature Shape-Memory Effects in Alloys of the TiNi—TiPd System," Translated from Doklady Akademii Nauk SSSR, vol. 257, No. 1, pp. 167-169, Mar. 1981. Plenum Publishing Corporation, New York, NY, 1981, pp. 195-197.
Köhl, Manuel et al., "Powder Metallurgical Near-Net-Shape Fabrication of Porous NiTi Shape Memory Alloys for Use as Long-Term Implants by the Combination of the Metal Injection Molding Process with the Space-Holder Technique," *Advanced Engineering Materials*, 11, 12 (2009) pp. 959-968.
Krone, L. et al., "Mechanical Behavior of NiTi Parts Prepared by Powder Metallurgical Methods," *Materials Science and Engineering* A 378 (2004) pp. 185-190.
Lindquist, P.G. "Structure and Transformation Behavior of Martensitic Ti—(Ni, Pd) and Ti—(Ni, Pt) Alloys," University Microfilms International, Ann Arbor, MI, 1988, Order No. 8908756, 134 pages.
Lindquist, P.G.; Wayman, C.M. "Shape Memory and Transformation Behavior of Martensitic Ti—Pd—Ni and Ti—Pt—Ni Alloys," *Engineering Aspects of Shape Memory Alloys*, Butterworth-Heinemann, Ltd., London, UK, 1990, pp. 58-68.
Liu, A.; Meng, X.; Cai, W.; Zhao, L. "Effect of Ce Addition on Martensitic Transformation Behavior of TiNi Shape Memory Alloys," *Materials Science Forum*, 2005, 475-479, pp. 1973-1976, 6 pages.
Liu, A.L.; Gao, Z.Y.; Gao, L.; Cai, W.; Wu, Y. "Effect of Dy Addition on the Microstructure and Martensitic Transformation of a Ni-rich TiNi Shape Memory Alloy," *Journal of Alloys and Compounds*, 2007, 437, pp. 339-343.
Liu, J.; Ma, J.; Wang, Z.; Wu, G. "Effects of Aging Treatment on Shape Memory Characteristics of Ni—Ti—Ta Alloy," *Rare Metal Materials and Engineering*, 2003, 32(10), pp. 777-781 (6 pages).

(56) References Cited

OTHER PUBLICATIONS

Liu, J.; Pan, S.; Zhuang, Y. "Isothermal Section of the Phase Diagram of the Ternary System Dy—Ni—Ti at 773 K," *Journal of Alloys and Compounds*, 2000, 313, pp. 93-94.
Liu, M.; Tu, M.J.; Zhang, X.M.; Li, Y.Y.; Shelyakov, A.V. "Microstructure of Melt-Spinning High Temperature Shape Memory Ni—Ti—Hf Alloys," *Journal of Materials Science Letters*, 2001, 20, pp. 827-830.
Ma, J.; Liu, J.; Wang, Z.; Xue, F.; Wu, K-H.; Pu, Z. "Effects of Ta Addition on NiTi Shape Memory Alloys," *J. Mater. Sci. Technol.*, 2000, 16(5), pp. 534-536.
Ma, J.; Yang, F.; Subirana, J.I.; Pu, Z.J.; Wu; K.H. "Study of NiTi—Ta Shape Memory Alloys," *SPIE Conference on Smart Materials Technologies*, 1998, 3324, pp. 50-57.
Matsumoto, Akihiro et al., "Fabrication of Ti—Zr—Ni Bulk Quasicrystal by Mechanical Alloying and Pulse Current Sintering," *Journal of Alloys and Compounds*, 434-435 (2007) pp. 315-318.
McNeese, Matthew D. et al., "Processing of TiNi from Elemental Powders by Hot Isostatic Pressing," *Materials Science and Engineering*, A280 (2000) pp. 334-348.
Meisner, L.L.; Sivokha, V.P. "The Effect of Applied Stress on the Shape Memory Behavior of TiNi-Based Alloys with Different Consequences of Martensitic Transformations," *Physica B*, 2004, 344, pp. 93-98.
Mentz, J. et al., "Improvement of Mechanical Properties of Powder Metallurgical NiTi by Reduction of Impurity Phases," *Proceedings of the International Conference on Shape Memory and Superelastic Technologies*, (2008) pp. 399-407.
Mentz, Juliane et al., "Powder Metallurgical Processing of NiTi Shape Memory Alloys with Elevated Transformation Temperatures," *Materials Science and Engineering*, A491 (2008) pp. 270-278.
Neves, F. et al., "Mechanically Activated Reactive Forging Synthesis (MARFOS) of NiTi," *Intermetallics*, 16 (2008) pp. 889-895.
Neves, F. et al., "Reactive Extrusion Synthesis of Mechanically Activated Ti—50Ni Powders," *Intermetallics*, 15 (2007) pp. 1623-1631.
Noebe, R.; Biles, T.; Padula, S.A. "NiTi-Based High-Temperature Shape-Memory Alloys: Properties, Prospects, and Potential Applications," *Materials Engineering*, 2006, 32, pp. 145-186, Marcel Dekker, Inc., New York, USA, 75 pages.
Noebe, R.; Gaydosh, D.; Padula, S.; Garg, A.; Biles, T.; Nathal, M. "Properties and Potential of Two (Ni,Pt)Ti Alloys for Use as High-Temperature Actuator Materials," *12th SPIE Conf. International Symposium*, San Diego, CA, USA, Mar. 6-10, 2005, pp. 1-12.
Notification of Reason for Rejection dated Jul. 13, 2016, for Japanese Patent Application No. 2014-536270 (translated), 3 pages.
Omori, Mamoru, "Sintering, Consolidation, Reaction and Crystal Growth by the Spark Plasma System (SPS)," *Materials Science and Engineering*, A287 (2000) pp. 183-188.
Otsuka, K. et al., "Physical Metallurgy of Ti—Ni—Based Shape Memory Alloys," *Progress in Materials Science*, 50 (2005) pp. 511-678.
Otsuka, K.; Oda, K.; Ueno, Y.; Piao, M.; Ueki, T.; Horikawa, H. "The Shape Memory Effect in a $Ti_{50}Pd_{50}$ Alloy," *Scripta Metallurgica et Materialia*, 1993, 29, pp. 1355-1358.
Oyamada, O.; Amano, K.; Enomoto, K., Shigenaka, N.; Matsumoto, J.; Asada, Y. "Effect of Environment on Static Tensile and Fatigue Properties of Ni—Ti—Nb Shape Memory Alloy," *JSME International Journal*, 1999, Series A, 42, pp. 243-248.
Patoor, E. et al., "Shape Memory Alloys, Part I: General Properties and Modeling of Single Crystals," *Mechanics of Materials*, 38 (2006) pp. 391-429.
Pozdnyakova, A. et al., "Analysis of Porosity in NiTi SMA's Changed by Secondary Pulse Electric Current Treatment by Means of Ultra Small Angle Scattering and Micro-Computed Tomography," *Intermetallics*, 18 (2010) pp. 907-912.
Pryakhina, L.I.; Myasnikova, K.P.; Burnashova, V.V.; Cherkashin, E.E.; Markiv, V.Y. "Ternary Intermetallic Compounds in the System Ni—Ti—Nb," A. A. Baikov Institute of Metallurgy; (Translated from *Poroshkovaya Metallurgiya*, 1966, 8(44), pp. 61-69) pp. 643-650.
Qiang, D.S.; Ying, Q.G.; Bo, Y.H.; Ming, T.S. "Phase Transformation and Memory Effect of the High Temperature Shape Memory Alloy $Ti_{49}Ni_{25}Pd_{26}B_{0.12}$," *Shape Memory Materials'94 Proceedings of the International Symposium on Shape Memory Materials*, 1994, International Academic Publishers, Beijing, China, pp. 248-252 (6 pages).
Rios, O.; Noebe, R.; Biles, T.; Garg, A.; Palczer, A.; Scheiman, D.; Seifert, H.J.; Kaufman, M. "Characterization of Ternary NiTiPt High-Temperature Shape Memory Alloys," *12th SPIE Conf. International Symposium*, San Diego, CA, USA, Mar. 6-10, 2005, pp. 1-12.
Russell, S.M.; Hodgson, D.E.; Basin, F. "Improved NiTi Alloys for Medical Applications," SMST-97: *Proceedings of the Second International Conference on Shape Memory and Superelastic Technologies*, Pacific Grove, CA, 1997, pp. 429-436.
Sadrnezhaad, S.K. et al., "Effect of Mechanical Alloying and Sintering on Ni—Ti Powders," *Materials and Manufacturing Processes*, 19, 3 (2004) pp. 475-486.
Schüller, E. et al., "Phase Transformation Temperatures for NiTi Alloys Prepared by Powder Metallurgical Processes," *Materials Science and Engineering* A 378 (2004) pp. 165-169.
Second (Final) Office Action (translated) dated Jan. 4, 2017, issued by the Japanese Intellectual Property Office for Japanese Patent Application No. 2014-536270, 3 pages.
Seo, C-Y.; Choi, S-J.; Choi, J.; Park, C-N.; Lee, P.S.; Lee, J-Y. "Effect of Ti and Zr Additions on the Characteristics of $AB_5$-type Hydride Electrode for Ni—MH Secondary Battery," *International Journal of Hydrogen Energy*, 2003, 28, 317-327.
Shearwood, C. et al., "Spark Plasma Sintering of TiNi Nano-Powder," *Scripta Materialia*, 52,6 (2005) pp. 455-460.
Shimizu, S.; Xu, Y.; Okunishi, E.; Tanaka, S.; Otsuka, K.; Mitose, K. "Improvement of Shape Memory Characteristics by Precipitation-Hardening of Ti—Pd—Ni Alloys," *Materials Letters*, 1998, 34, pp. 23-29.
Strnadel, B. et al., "Effect of Mechanical Cycling on the Pseudoelasticity Characteristics of Ti—Ni and Ti—Ni—Cu Alloys," *Materials Science and Engineering*, A203 (1995) pp. 187-196.
Sun, L.; Wu, K-H. "The Two-Way Memory Effect (TWME) in NiTi—Pd High Temperature Shape Memory Alloys," *SPIE Conference Proceedings: Smart Structures and Materials*, 1994, 2189, pp. 298-305.
Suzuki, Y. et al., "Effects of Boron Addition on Microstructure and Mechanical Properties of Ti—Td—Ni High Temperature Shape Memory Alloys," *Materials Letters*,36 (1998) pp. 85-94.
Suzuki, Y.; Xu, Y.; Morito, S.; Otsuka, K.; Mitose, K. "Effects of Boron Addition on Microstructure and Mechanical Properties of Ti—Pd—Ni High-Temperature Shape Memory Alloys," *Materials Letters*, 1998, 36, pp. 85-94.
Thoma, P.E.; Boehm, J.J. "The Effect of Hafnium and Thermal Cycling on the Transformation Temperatures of NiTi-Based Shape Memory Alloys," *Mat. Res. Soc. Symp. Proc.*, 2000, 604, pp. 221-226.
Tian, Q. et al., "Superelasticity of TiPdNi Alloys with and without Rare Earth Ce Addition," *J. Mater. Sci. Technol.*, 19, 2 (2003) pp. 179-182.
*Using Nitinol Alloys*, Johnson Matthey, San Jose, CA, 2004, 1-46.
Wong, T.; Seuntjens, J.M.; "Development of Rare Earth Regenerator Materials in Fine Wire Form," *Adv. Cryog. Eng.*, 1997, 42, pp. 439-444, 2 page Abstract.
Wu, K.H.; Liu, Y.Q.; Maich, M.; Tseng, H.K. "The Mechanical Properties of a NiTi—Pd High Temperature Shape Memory Alloy," *SPIE Conference Proceedings: Smart Structures and Materials*, 1994, 2189, pp. 306-313.
Wu, S.K.; Wayman, C.M. "Martensitic Transformations and the Shape Memory Effect in $Ti_{50}Ni_{10}Au_{40}$ and $Ti_{50}Au_{50}$ Alloys," *Metallography*, 1987, 20, pp. 359-376.
Xu, Y. et al., "Recovery and Recrystallization Processes in Ti—Pd—Ni High Temperature Shape Memory Alloys," *Acta. Mater.* 45, 4 (1997) pp. 1503-1511.

(56) References Cited

OTHER PUBLICATIONS

Xu, Y.; Otsuka, K.; Furubayashi, E.; Mitose, K. "TEM Observation of Recrystallization Process in Solution-Treated $Ti_{50}Pd_{50}$ Martensite," *Materials Letters*, 1998, 34, pp. 14-18.
Xu, Y.; Shimizu, S.; Suzuki, Y.; Otsuka, K.; Ueki, T.; Mitose, K. "Recovery and Recrystallization Processes in Ti—Pd—Ni High-Temperature Shape Memory Alloys," *Acta Mater*., 1997, 45(4), pp. 1503-1511.
Yang, W.S.; Mikkola, D.E. "Ductilization of Ti—Ni—Pd Shape Memory Alloys with Boron Additions," *Scripta Metallurgica et Materialia*, 1993, 28, pp. 161-165.
Ye, L.L. et al., "Consolidation of MA amorphous NiTi powders by spark plasma sintering," *Materials Science and Egineering: A*, 241, 1-2, Jan. 1998, pp. 290-293.
Zadno, G.R.; Duerig, T.W. "Linear Superelasticity in Cold-Worked Ni—Ti," *Engineering Aspects of Shame Memory Alloys*, Butterworth-Heinemann, Ltd., 1990, pp. 414-419.
Zhang, C.; Thoma, P.; Chin, B.; Zee, R. "Martensitic and R-Phase Transformations in Ni—Ti and Ni—Ti—Hf," *Trans. Nonferrous Met. Soc. China*, 1999, 9(1), pp. 55-64.
Zhao, C. "Improvement of Shape Memory Effect in Fe—Mn—Si—Cr—Ni Alloys," *Metallurgical and Materials Transactions A*, 1999, 30A, pp. 2599-2604.
Zhong, X. et al., "The 573 K and 773 K Isothermal Sections of the Phase Diagram of the Pr—Ni—Ti Ternary System," *Journal of Alloys and Compounds*, 316 (2001) pp. 172-174.
Zhu, Y.R.; Pu, Z.J.; Li, C.; Wu, K.H. "The Stability of NiTi—Pd and NiTi—Hf High Temperature Shape Memory Alloys," *Shape Memory Materials'94 Proceedings of the International Symposium on Shape Memory Materials*, 1994, International Academic Publishers, pp. 253-257 (6 pages).

* cited by examiner

Electron Image 1

| | Ti | Ni | Er |
|---|---|---|---|
| Spectrum 1 | 4.30 | 2.80 | 92.90 |
| Spectrum 2 | 7.15 | 5.13 | 87.72 |
| Spectrum 3 | 50.86 | 48.78 | 0.35 |
| Spectrum 4 | 50.02 | 49.70 | 0.28 |

| | Ti | Ni | Er |
|---|---|---|---|
| Spectrum 1 | 3.88 | 3.29 | 92.82 |
| Spectrum 2 | 2.88 | 1.42 | 95.71 |
| Spectrum 3 | 50.61 | 49.30 | 0.10 |
| Spectrum 4 | 54.72 | 45.20 | 0.08 |
| Spectrum 5 | 51.06 | 48.76 | 0.18 |

| Spectrum | Ti | Fe | Ni | Er |
|---|---|---|---|---|
| Spectrum 1 | 4.31 | 0.03 | 46.81 | 48.85 |
| Spectrum 2 | 34.40 | 0.80 | 38.71 | 26.09 |
| Spectrum 3 | 51.48 | 0.27 | 48.03 | 0.22 |
| Spectrum 4 | 50.67 | 0.09 | 49.18 | 0.15 |

| Spectrum | Ti | Fe | Ni | Er |
|---|---|---|---|---|
| Spectrum 1 | 2.61 | 0.00 | 47.79 | 49.61 |
| Spectrum 2 | 2.16 | 0.10 | 47.11 | 50.63 |
| Spectrum 3 | 49.43 | 0.00 | 50.51 | 0.06 |
| Spectrum 4 | 50.44 | 0.13 | 49.33 | 0.10 |
| Spectrum 5 | 50.38 | 0.00 | 49.60 | 0.02 |
| Spectrum 6 | 43.96 | 0.47 | 41.69 | 13.88 |

| Spectrum | Ti | Ni | Ag | Er |
|---|---|---|---|---|
| Spectrum 1 | 3.27 | 1.89 | 46.29 | 48.55 |
| Spectrum 2 | 3.61 | 3.81 | 45.84 | 46.84 |
| Spectrum 3 | 50.45 | 49.42 | 0.04 | 0.08 |
| Spectrum 4 | 50.08 | 49.83 | 0.01 | 0.10 |

METHOD OF FORMING A SINTERED NICKEL-TITANIUM-RARE EARTH (NI—TI—RE) ALLOY

RELATED APPLICATION

The present patent document is a division of U.S. patent application Ser. No. 13/656,151, filed Oct. 19, 2012, which claims the benefit of priority to Great Britain Patent Application No. 1118208.6, filed Oct. 21, 2011, both of which are hereby incorporated by reference in their entirety.

TECHNICAL FIELD

The present disclosure is related generally to nickel-titanium alloys and more particularly to powder metallurgical processing of nickel-titanium alloys including a rare earth constituent.

BACKGROUND

Nickel-titanium alloys are commonly used for the manufacture of intraluminal biomedical devices, such as self-expandable stents, stent grafts, embolic protection filters, and stone extraction baskets. Such devices may exploit the superelastic or shape memory behavior of equiatomic or near-equiatomic nickel-titanium alloys, which are commonly referred to as Nitinol. As a result of the poor radiopacity of nickel-titanium alloys, however, such devices may be difficult to visualize from outside the body using non-invasive imaging techniques, such as x-ray fluoroscopy. Visualization is particularly problematic when the intraluminal device is made of fine wires or thin-walled struts. Consequently, a clinician may not be able to accurately place and/or manipulate a Nitinol stent or basket within a body vessel.

Current approaches to improving the radiopacity of nickel-titanium medical devices include the use of radiopaque markers, coatings, or cores made of heavy metal elements. In addition, noble metals such as platinum (Pt), palladium (Pd) and gold (Au) have been employed as alloying additions to the improve the radiopacity of Nitinol, despite the high cost of these elements. In a more recent development, it has been shown (e.g., U.S. Patent Application Publication 2008/0053577, "Nickel-Titanium Alloy Including a Rare Earth Element," which is hereby incorporated by reference in its entirety) that rare earth elements such as erbium can be alloyed with Nitinol to yield a ternary alloy with radiopacity that is comparable to if not better than that of a Ni—Ti—Pt alloy.

Ternary nickel-titanium alloys that include rare earth or other alloying elements are commonly formed by vacuum melting techniques. However, upon cooling the alloy from the melt, a brittle network of secondary phase(s) may form in the alloy matrix, potentially diminishing the workability and mechanical properties of the ternary alloy. If the brittle second phase network cannot be broken up by suitable homogenization heat treatments and/or thermomechanical working steps, then it may not be possible to find practical application for the ternary nickel-titanium alloy in medical devices or other applications.

As stated in U.S. Patent Application Publication 2008/0053577, the nickel-titanium alloy has a phase structure that depends on the composition and processing history of the alloy. The rare earth element may form a solid solution with nickel and/or titanium. The rare earth element may also form one or more binary intermetallic compound phases with nickel and/or with titanium. In other words, the rare earth element may combine with nickel in specific proportions and/or with titanium in specific proportions. Without wishing to be bound by theory, it is believed that most of the rare earth elements set forth as preferred ternary alloying additions will substitute for titanium and form one or more intermetallic compound phases with nickel, such as, for example, NiRE, $Ni_2RE$, $Ni_3RE_2$ or $Ni_3RE_7$. In some cases, however, the rare earth element may substitute for nickel and combine with titanium to form a solid solution or a compound such as $Ti_xRE_y$. The nickel-titanium alloy may also include one or more other intermetallic compound phases of nickel and titanium, such as NiTi, $Ni_3Ti$ and/or $NiTi_2$, depending on the composition and heat treatment. The rare earth addition may form a ternary intermetallic compound phase with both nickel and titanium atoms, such as $Ni_xTi_yRE_z$. Some exemplary phases in various Ni—Ti-RE alloys are identified below in TABLE 1. Also, in the event that one or more additional alloying elements are present in the nickel-titanium alloy, the additional alloying elements may form intermetallic compound phases with nickel, titanium, and/or the rare earth element.

TABLE 1

Exemplary Phases in Ni—Ti-RE Alloys

| Alloy | Exemplary Phases |
|---|---|
| Ni—Ti—Dy | DyNi, $DyNi_2$, $Dy_xTi_y$, α(Ti), α(Ni), $Ni_xTi_yDy_z$ |
| Ni—Ti—Er | ErNi, $ErNi_2$, $Er_xTi_y$, α(Ti), α(Ni), $Ni_xTi_yEr_z$ |
| Ni—Ti—Gd | GdNi, $GdNi_2$, $Gd_xTi_y$, α(Ti), α(Ni), $Ni_xTi_yGd_z$ |
| Ni—Ti—La | LaNi, $La_2Ni_3$, $La_xTi_y$, α(Ti), α(Ni), $Ni_xTi_yLa_z$ |
| Ni—Ti—Nd | NdNi, $NdNi_2$, $Nd_xTi_y$, α(Ti), α(Ni), $Ni_xTi_yNd_z$ |
| Ni—Ti—Yb | $YbNi_2$, $Yb_xTi_y$, α(Ti), α(Ni), $Ni_xTi_yYb_z$ |

BRIEF SUMMARY

A method of forming a sintered nickel-titanium-rare earth (Ni—Ti-RE) alloy that exhibits superelasticity and can be mechanically worked into a form useful for medical devices or other products has been developed. Advantageously, the sintering method may produce a sintered Ni—Ti-RE alloy that has a suitable hardness and second phase morphology to be workable using conventional metal working techniques, and the sintered Ni—Ti-RE alloy may also exhibit superelastic behavior at body temperature.

The method includes adding one or more powders comprising Ni, Ti, and a rare earth constituent to a powder consolidation unit which includes an electrically conductive die and punch connected to a power supply. A pulsed electrical current may be passed through the one or more powders. The powders are heated at a ramp rate of about 35° C./min or less to a sintering temperature. Pressure is applied to the powders at the sintering temperature, and a sintered Ni—Ti-RE alloy is formed.

The powders may be heated at a ramp rate of, for example, up to about 25° C./min.

The powders may be heated at a ramp rate of, for example, greater than or equal to about 1° C./min, or greater than or equal to about 5° C./min. Very slow ramp rates can have the disadvantage, however, that the metals are kept at a high temperature for a long period of time, and thus may result in large grain size in the sintered alloy. Further, the cost of such low ramp rates may be prohibitive, depending on the size of the sintering container used.

The sintering temperature may be less than the melting temperature of the rare earth constituent. The sintering temperature may be equal to a softening temperature of the rare earth constituent, or, equivalently, fall within a softening temperature range of the rare earth constituent. The sintering temperature may be between about 650° C. and about 900° C. The sintering temperature may be between 750° C. and 800° C. The sintering temperature may be between 750° C. and 835° C. The softening temperature may be between 700° C. and 835° C. The softening temperature may be between 780° C. and 835° C. The softening temperature may be related to the absolute melting temperature ($T_m$) of the rare-earth constituent. For example, the softening temperature may be from 0.45 $T_m$ to 0.6 $T_m$. The softening temperature may be from 0.45 $T_m$ to 0.55 $T_m$. The softening temperature may be from 0.50 $T_m$ to 0.55 $T_m$.

The softening temperature may be a temperature at which the rare earth constituent has a Rockwell (E) hardness of from 17 to 20. The softening temperature may be a temperature at which the rare earth constituent has a Rockwell (E) hardness of from 16 to 21, or from 17 to 25.

The rare earth constituent may be a rare earth element, or a compound including a rare-earth element.

The pressure may lie between about 45 MPa and about 110 MPa. The sintered Ni—Ti-RE alloy may have a density of at least about 95% of theoretical density. The rare earth constituent may be selected from the group consisting of Dy, Er, Gd, Ho, La, Lu, Sc, Sm, Tb, Tm, Y, and Yb. The rare earth constituent may comprise an element selected from the group consisting of Dy, Er, Gd, Ho, La, Lu, Sc, Sm, Tb, Tm, Y, and Yb. Preferably, the rare earth constituent may comprise erbium.

The one or more powders may include elemental Ni powders and elemental Ti powders. The one or more powders may include prealloyed Ni—Ti powders. The one or more powders may include prealloyed RE-X powders, where X is an element selected from Ag and Au. The one or more powders may include elemental rare earth powders. The one or more powders including the rare earth constituent may further comprise a dopant selected from Fe and B.

The method may further comprise the step of hot working the sintered Ni—Ti-RE alloy.

The pressure during sintering can be increased to compensate for a reduction in sintering temperature. The average particle size of the powders can be decreased to compensate for a reduction in sintering temperature.

The sintered Ni—Ti-RE alloy may include Ni at a concentration of from about 35 at. % to about 65 at. %; Ti at a concentration of from about 35 at. % to about 65 at. %; and a rare earth (RE) element at a concentration of from about 1.5 at. % to about 15 at. %. The sintered Ni—Ti-RE alloy may include a matrix phase and a second phase, the second phase comprising discrete regions in the matrix phase and including a RE element. In one example, the sintered Ni—Ti-RE alloy may comprise: Ni at a concentration of from about 45 at. % to 55 at. %; Ti at a concentration of from about 45 at. % to 55 at. %; and a rare earth (RE) constituent at a concentration of from about 2.5 at. % to 12.5 at. %.

The sintered Ni—Ti-RE alloy may comprise an additional alloying element selected from the group consisting of Al, Cr, Mn, Fe, Co, Cu, Zn, Ga, Ge, Zr, Nb, Mo, Tc, Ru, Rh, Pd, Ag, Cd, In, Sn, Sb, Hf, Ta, W, Re, Os, Ir, Pt, Au, Hg, Tl, Pb, Bi, Po, and V. The additional alloying element may be selected from the group consisting of Fe and Ag.

The second phase may include the additional alloying element. The second phase may have a formula $M_xRE_y$, where M is the additional alloying element. Each of x and y may have an integer value or a fractional value, where $0<x<100$ and $0<y<100$, in terms of atomic percent (at. %). For example, x may be between about 0.1 at. % and 95 at. %; x and y may sum to approximately 100 at. %, or x and y and the amount of any contaminants may sum to 100 at. %. M may be selected from the group consisting of: Zr, Nb, Mo, Hf, Ta, W, Re, Ru, Rd, Pd, Ag, Os, Ir, Pt. Au, Mg, Ca, Sr, Ba, Sc, Ti, V, Cr, Mn, Fe, Co, Ni, Cu, Zn, Al, rare earth elements, and Y. The second phase may have a formula $Er_{95.64}Fe_{4.36}$, or $Ag_{50}Er_{50}$for example.

M may be a metal which can add to the radiopacity of the sintered alloy, such as Zr, Nb, Mo, Hf, Ta, W, Re, Ru, Rd, Pd, Ag, Os, Ir, Pt and Au. Where M is a metal which can add to the radiopacity of the sintered alloy, x may be between 0.1 at. % and 95 at. %. M may be a metal which has a compound with RE that is sinterable with NiTi to form an alloy. Preferably that alloy is subsequently workable by hot and cold working. Where M is Ag and RE is Er, x may be, for example, about 0.1-51 at. %, and y may be, for example, about 49-99.9 at. %. Where M is Zr, Nb, Hf, or Tb and RE is Er, x may be about 0.1-7 at. %, or more preferably about 0.1-5 at. %, y may be approximately 93-99.9 at. %. Where M is W and RE is Er, x may be about 0.1-2 at. %, and y may be approximately 98-99.9 at. %. Where M is Mo and RE is Er, x may be about 0.1-5 at. %, and y may be approximately 95-99.9 at. %.

M may be an alkaline earth or transition metal such as, Mg, Ca, Sr, Ba, Sc, Ti, V, Cr, Mn, Fe, Co, Ni, Cu, Zn and Al. These metals may have a tendency to reduce the interparticular flow of metallic RE during sintering with NiTi. The proportion of M should be low enough to maintain the purity of the RE and the ductility of the alloy. Where M is an alkaline earth or transition metal metal, x may be between about 0.003 at. % and about 15 at. %, more preferably between 0.003 at. % and 10 at. %. Y may be approximately 85-99.997 at. %.

M may be a second rare earth element. Where M is a second rare earth element, x may be approximately 0.01 to 50 at. %.

M may be Y (yttrium), which is sometimes considered to be a rare earth element. Y can aid the ductility of the alloy. Where M is Y, x may be about 0.01 to 50 at. %.

The second phase may include nickel (Ni). The second phase may have a formula $RE_xNi_y$. Each of x and y may have an integer value or a fractional value, where $0<x<100$ and $0<y<100$, in terms of atomic percent (at. %). For example, x may be between about 0.1 at. % and 95 at. %; x and y may sum to approximately 100 at. %, or x and y and the amount of any contaminants may sum to 100 at. %. For example, x may be about 33 at. % to 99 at. %. Preferably, x is from about 50 at. % to about 67 at. %. More preferably, x is about 50 at. %. RE may be any rare earth element. RE may preferably be Er. For example, the second phase may be selected from the group consisting of: $Gd_xNi_y$, $Nd_xNi_y$ and $Er_xNi_y$.

The second phase may include an additional alloying element and nickel (Ni). The second phase may include titanium (Ti). The discrete particles of the second phase may have an average size of from about 1 to about 500 microns, and preferably from about 1 to about 150 microns. The matrix phase may comprise NiTi.

BRIEF DESCRIPTION OF THE DRAWINGS

FIG. 1A is obtained from Hungria T. et al., (2009) "Spark Plasma Sintering as a Useful Technique to the Nanostructuration of Piezo-Ferroelectric Materials," Advanced Engineering Materials 11:8, p. 615-631;

DETAILED DESCRIPTION

Definitions

Figure 1A:
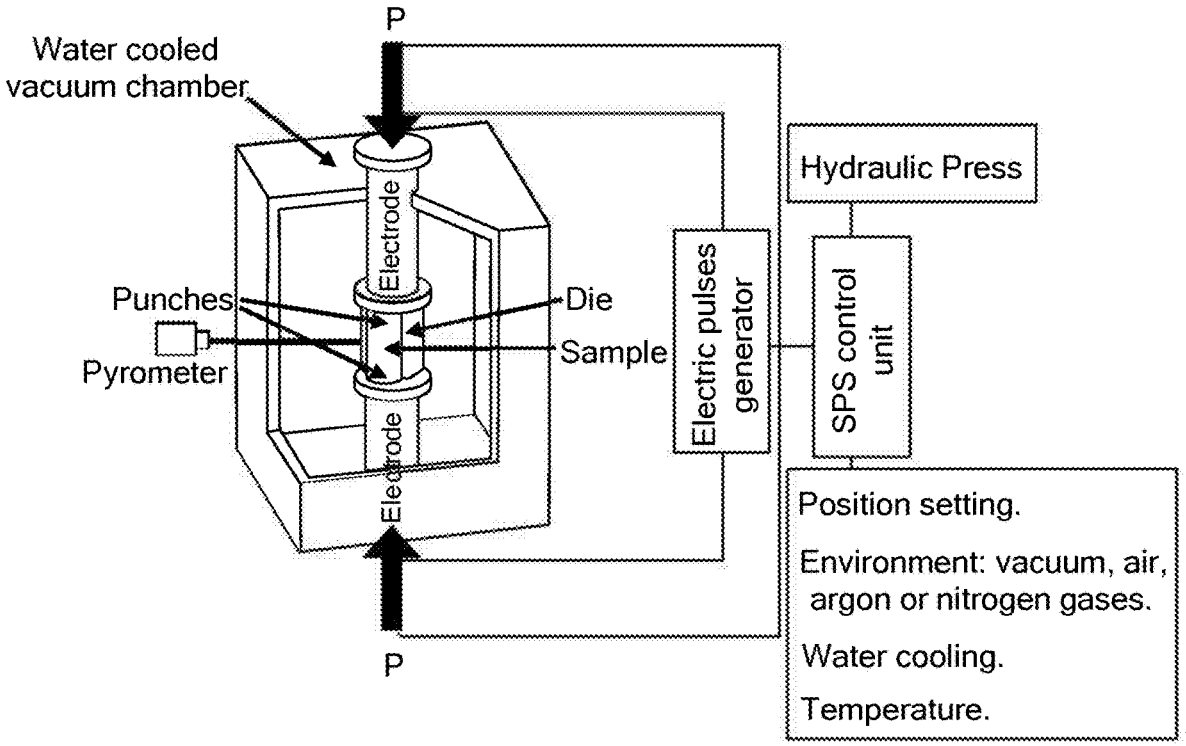
FIGS. 1A and 1B are cross-sectional schematics of a spark plasma sintering (SPS) apparatus and an SPS die, respectively, where

As used in the following specification and the appended claims, the following terms have the meanings ascribed below:

Martensite start temperature (Ms) is the temperature at which a phase transformation to martensite begins upon cooling for a shape memory material exhibiting a martensitic phase transformation.

Martensite finish temperature (Mf) is the temperature at which the phase transformation to martensite concludes upon cooling.

Austenite start temperature (As) is the temperature at which a phase transformation to austenite begins upon heating for a shape memory material exhibiting an austenitic phase transformation.

Austenite finish temperature (Af) is the temperature at which the phase transformation to austenite concludes upon heating.

Radiopacity is a measure of the capacity of a material or object to absorb incident electromagnetic radiation, such as x-ray radiation. A radiopaque material preferentially absorbs incident x-rays and tends to show high radiation contrast and good visibility in x-ray images. A material that is not radiopaque tends to transmit incident x-rays and may not be readily visible in x-ray images.

The term "workability" refers to the ease with which an alloy may be formed to have a different shape and/or dimensions, where the forming is carried out by a method such as rolling, forging, extrusion, etc.

The term "prealloyed" is used to describe powders that are obtained from an ingot of a particular alloy composition that has been converted to a powder (e.g., by gas atomization).

The phrase "sintering temperature" refers to a temperature at which precursor powders may be sintered together when exposed to an applied pressure.

The phrase "softening temperature," when used in reference to a rare earth element, refers to a temperature at which the rare earth element softens, as determined by hot hardness measurements or melting temperature data (see discussion below). In general, the phrase "softening temperature" can be used to describe temperatures at which a given constituent is not so soft so as to be able to flow between other constituents of the alloy, i.e., where there is no interparticle flow of the given constituent, but is soft enough to allow diffusion bonding between the given constituent and other constituents of the alloy, i.e., where metal to metal transfers can occur.

Spark Plasma Sintering Process

An innovative powder metallurgy process based on a spark plasma sintering (SPS) method is set forth herein for preparing nickel-titanium alloys including a rare earth (RE) element. SPS entails compacting metal and/or alloy powder into a dense specimen by passing a pulsed electrical current though the powder while under an applied pressure. A high current, low voltage pulse current may generate a spark plasma at high localized temperatures throughout the compact, generating heat uniformly through the powder.

In contrast to conventional melting techniques (e.g., vacuum induction melting (VIM) or vacuum arc melting (VAR)) for Ni—Ti-RE alloy fabrication, SPS may result in fine dispersion of the rare earth element or a secondary phase within the alloy microstructure, and thus the billet or compact produced by SPS may not need to undergo a homogenization heat treatment prior to hot or cold working. Sintering also may permit a dense ternary alloy compact to be formed at a much lower temperature (e.g., <850° C.) than a typical melting process, which is typically carried out a temperature in excess of 1350° C., and the sintering temperature can be further reduced if desired by using smaller starting particle sizes and a higher sintering pressure. Another advantage of SPS is that the powder particles may be purified during sintering, thereby minimizing contaminants in the resulting ternary Ni—Ti-RE alloy. It is possible to obtain extremely low oxygen and acceptable carbon contents independent of the impurity level in the starting powder. SPS is generally seen as being an attractive process because of the high temperature ramp rates attainable which can result in reduced overall processing times, although high ramp rates are not necessarily advantageous here.

Figure 1B:
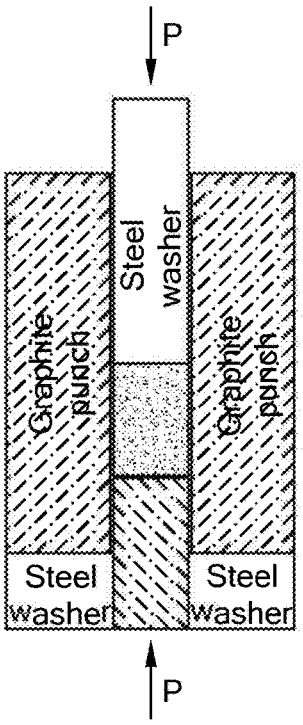

In the present investigation, the rate of the temperature increase to the sintering temperature (the ramp rate) and the selection of the sintering temperature are found to affect the success of the sintering process and the quality of resulting ternary alloy. To form a sintered Ni—Ti-RE alloy using an SPS process, one or more powders including Ni, Ti, and a rare earth element are added to a powder consolidation unit, which includes an electrically conductive die and punch connected to a power supply (see FIGS. 1A and 1B). A pulsed electrical current is passed through the one or more powders, and the powders are heated at ramp rate of about 35°/min or less to a desired sintering temperature. The ramp rate is preferably about 25°/min or less. Pressure is applied to the powders during sintering, and the sintering temperature is maintained for a hold time sufficient to form a sintered Ni—Ti-RE alloy having a density of at least about 95% of theoretical density. The pressure may also be applied to the powders as they are heated to the sintering temperature. Typically, the hold time is at least about 1 min, e.g., between about 1 min and about 60 min or between about 5 min and about 15 min, and the applied pressure may range from about 45 MPa to about 110 MPa. The sintering process may have a total time duration of about 72 minutes or less, which is significantly shorter than the time required for other sintering routes, despite the low ramp rates employed here.

In general, a low sintering temperature (e.g., <850° C.) and ramp rate (35° C.) can be utilized to successfully form a sintered Ni—Ti-RE alloy of the desired density using SPS processing. While a ramp rate in excess of 50° C. per minute (e.g., 100° C. per minute) is effective for the binary Ni—Ti powders, as discussed in the examples below, the inventors discovered that high ramp rates are problematic for the ternary Ni—Ti—Er system.

The sintering temperature of the Ni—Ti-RE alloy may coincide with a softening temperature of the rare earth element. As discussed further below, the softening temperature may be the temperature at which the rare earth element has a Rockwell (E) hardness of between 17 and 20. The softening temperature may also lie between about 0.50·Tm and about 0.55·Tm, where Tm is the absolute melting temperature of the rare earth element. For example, the desired sintering temperature may be between about 650° C. and about 850° C., or between about 700° C. and about 825° C. When the rare earth element is Er, the sintering temperature is preferably between about 750° C. and about 800° C.

The pressure during sintering can be increased to compensate for a reduction in sintering temperature, and/or the average particle size of the powders can be decreased.

Advantageously, the sintered alloy achieves a density of at least about 98% of theoretical density as a result of the sintering process. The SPS process described here is believed to be particularly advantageous for forming Ni—Ti-RE alloys suitable for various applications, including use in implantable medical devices. The Ni—Ti-RE alloys may comprise from about 34 at. % to about 60 at. % nickel, from about 34 at. % to about 60 at. % titanium, and from about 0.1 at. % to about 15 at. % at least one rare earth element. Ni—Ti-RE alloys are described in detail in U.S. Patent Application Publication 2008/0053577, "Nickel-Titanium Alloy Including a Rare Earth Element," filed on Sep. 6, 2007, and in U.S. Patent Application Publication 2011/0114230, "Nickel-Titanium Alloy and Method of Processing the Alloy," filed on Nov. 15, 2010, both of which are hereby incorporated by reference in their entirety.

The sintering method set forth herein may be carried out using a spark plasma sintering apparatus such as, for example, Dr. Sinterlab SPS 515S (Sumitomo Coal Mining Co. Ltd., Japan). The SPS die in this case is made from high grade graphite and the sintering is performed in vacuum (~$10^{-3}$ Torr). In a typical SPS run, a powder sample is packed into the high strength graphite die and placed between the upper and lower electrodes, as shown schematically in FIGS. 1A and 1B. Exemplary powder samples prior to sintering are shown in FIGS. 1C-1G. In the SPS apparatus, a pulsed direct current is applied through the electrodes and through the sample. For example, 12 current pulses and two off-current pulses, which is known as a 12/2 sequence, may be used. The sequence of 12 on pulses followed by 2 off pulses for a total sequence period of 46.2 ms calculates to a characteristic time of a single pulse of about 3.3 ms. A minimum uniaxial pressure (base pressure) may be applied and maintained to ensure electrical contact is maintained with the powder throughout the process; the electrodes may serve as the source of the applied pressure from the top and bottom of the die. The base pressure can be increased to a desired sintering pressure once the powders are at or near the sintering temperature.

Figure 2:
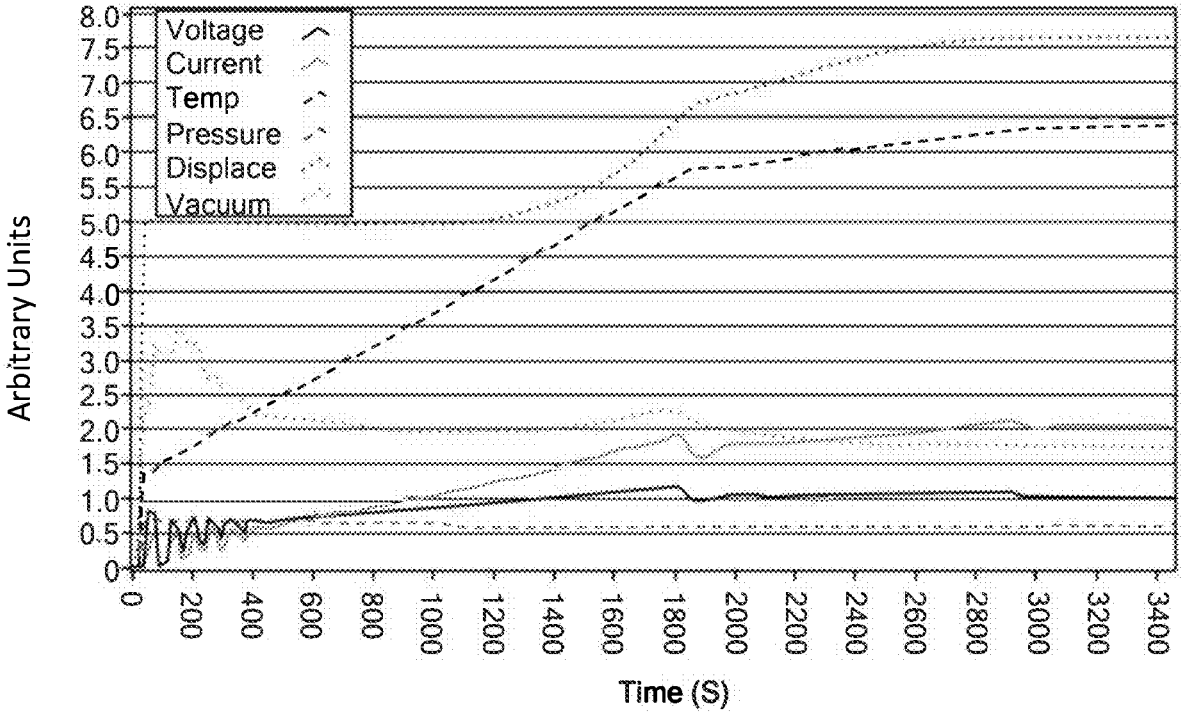
FIG. 2 shows exemplary SPS data for an optimized sintering process at a 25° C./min ramp rate and 815° C. sintering temperature, including current, temperature, voltage, pressure and displacement (compaction) time evolution curves, as recorded by an SPS machine.

A reduced ramp rate to the sintering temperature allows the Ni—Ti powders (which may be elemental Ni and Ti powders or prealloyed Ni—Ti powders) and the powders that include a rare earth (RE) element, each of which have different specific heats, to heat up together and equilibrate during the ramp. Tables 2 and 3 show specific heat and other data for several rare earth elements and a stoichiometric NiTi alloy. If the ramp rate is too high, the powders including the RE element (which may be elemental RE powders or prealloyed Ni-RE powders) may heat up more quickly than the Ni—Ti powders and melt in localized hot spots during heating—even to the point of running out of the die. FIG. 2 provides SPS data for an exemplary sintering process at an optimized ramp rate showing current, temperature, voltage, pressure, displacement (compaction), and vacuum time evolution curves as recorded by the SPS machine.

TABLE 2

Properties of Selected Rare Earth Elements

| | Er | Tb | Gd | Tm | Dy | Nd |
|---|---|---|---|---|---|---|
| Hardness (Rockwell E) | 73 | 69 | 72 | 86 | 71 | 51 |
| Melt temperature (° C.) | 1529 | 1356 | 1312 | 1545 | 1407 | 1024 |
| Density (g/cm^3) | 9.066 | 8.23 | 7.9 | 9.32 | 8.54 | 7.01 |

TABLE 2-continued

| Properties of Selected Rare Earth Elements | | | | | | |
|---|---|---|---|---|---|---|
| | Er | Tb | Gd | Tm | Dy | Nd |
| Resistivities (μΩ · cm) | 86 | 115 | 131 | 69 | 93 | 64 |
| Specific heat (J/kg · ° C.) | 170 | 180 | 230 | 160 | 170 | 190 |

TABLE 3

| Resistivity and Specific Heat for NiTi |
|---|
| Resistivity of NiTi (Mar - Aus) 80-100 micro-ohm*cm<br>Specific heat of NiTi (Mar - Aus) 470-620 J/kg C. |

Another problem at high ramp rates is that the RE element may alloy with Ni, potentially depleting the sintered Ni—Ti matrix of nickel and forming an embrittling ErxNiy interparticle network throughout the alloy. In addition, a low ramp rate may have the benefit of more effectively removing oxides and other impurities from particle surfaces during sintering, which may allow sintering to take place at lower temperatures and/or larger particle sizes.

Precursor Powders

The powders employed for the sintering may include prealloyed Ni—Ti powders of the appropriate composition (e.g., about 50 at. % Ni, about 50 at. % Ti, or a nickel-rich composition such as about 51 at. % Ni and about 49 at. % Ti, or about 52 at. % Ni and about 48 at. % Ti). Alternatively, elemental Ni powders and elemental Ti powders may be used in the same proportions. Throughout this disclosure, powders including the elements Ni and Ti may be referred to as Ni—Ti powders whether they are elemental Ni and Ti powders or prealloyed Ni—Ti powders.

Figure 1C:
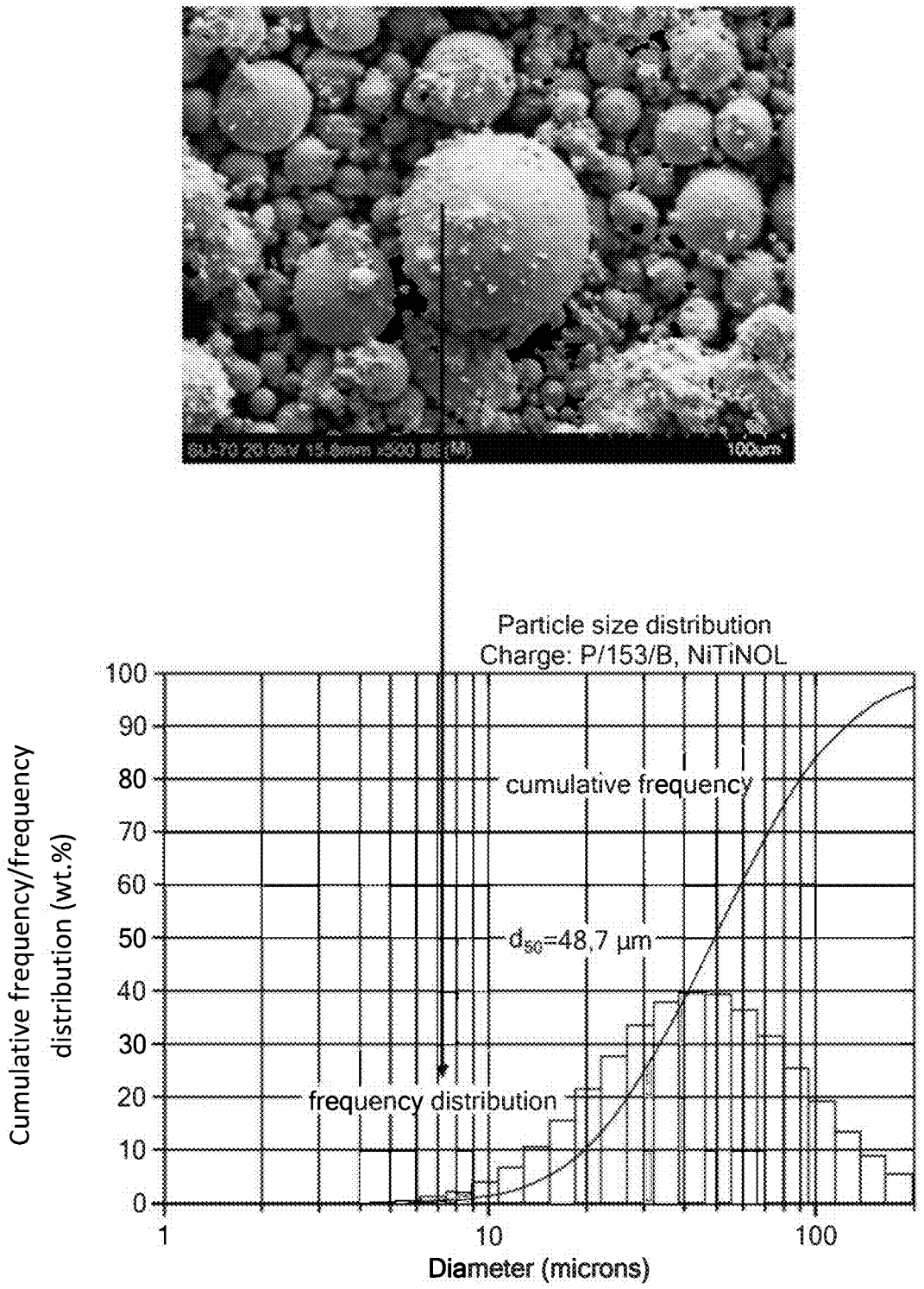
FIG. 1C is a scanning electron microscopy (SEM) image of exemplary as-received pre-alloyed gas atomized powders having a particle size distribution as shown, where d50 is the average particle size.
Figure 1D:
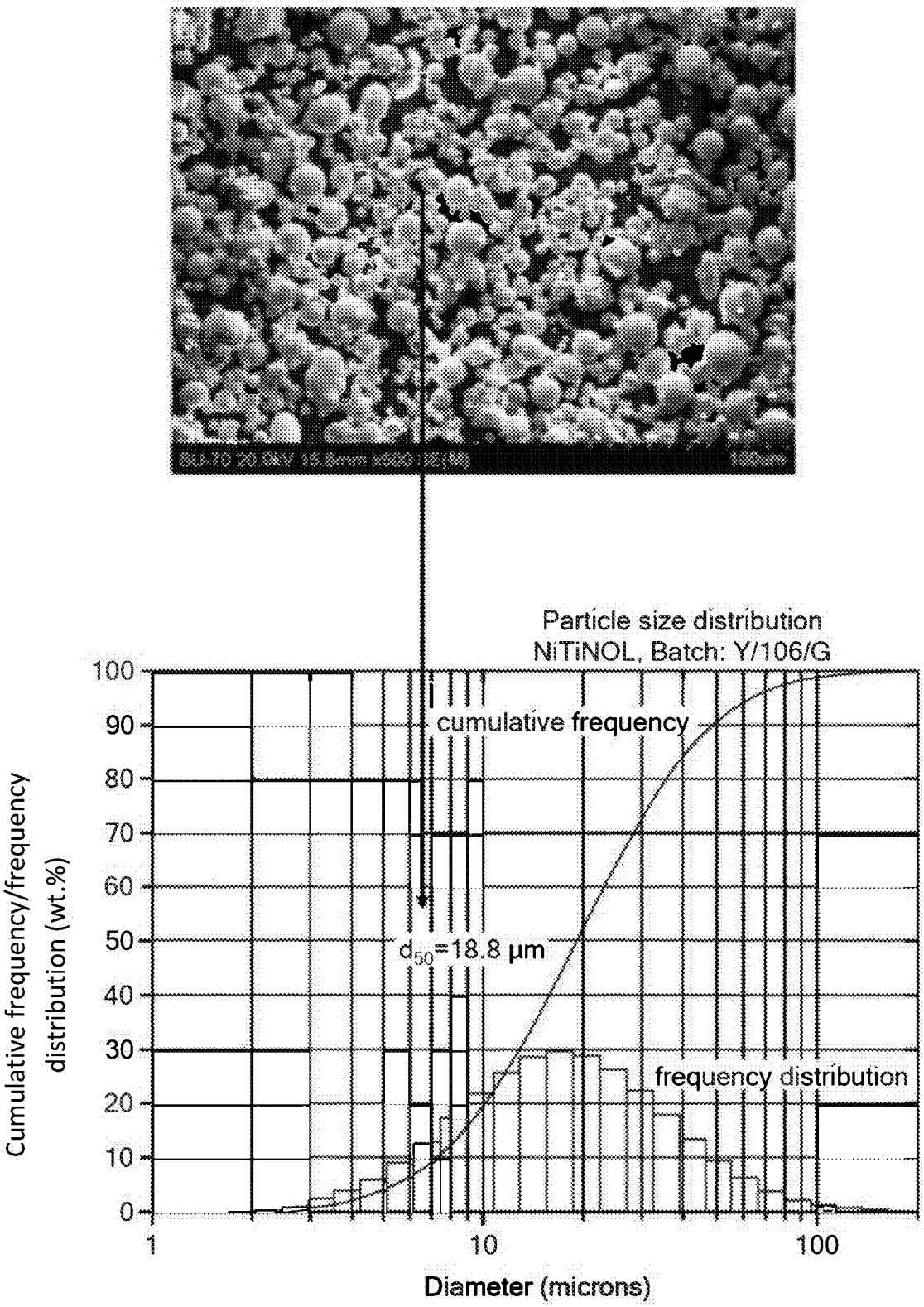
FIG. 1D is an SEM image of exemplary as-received pre-alloyed gas atomized powders having a particle size distribution as shown, where d50 is the average particle size.
Figure 1E:
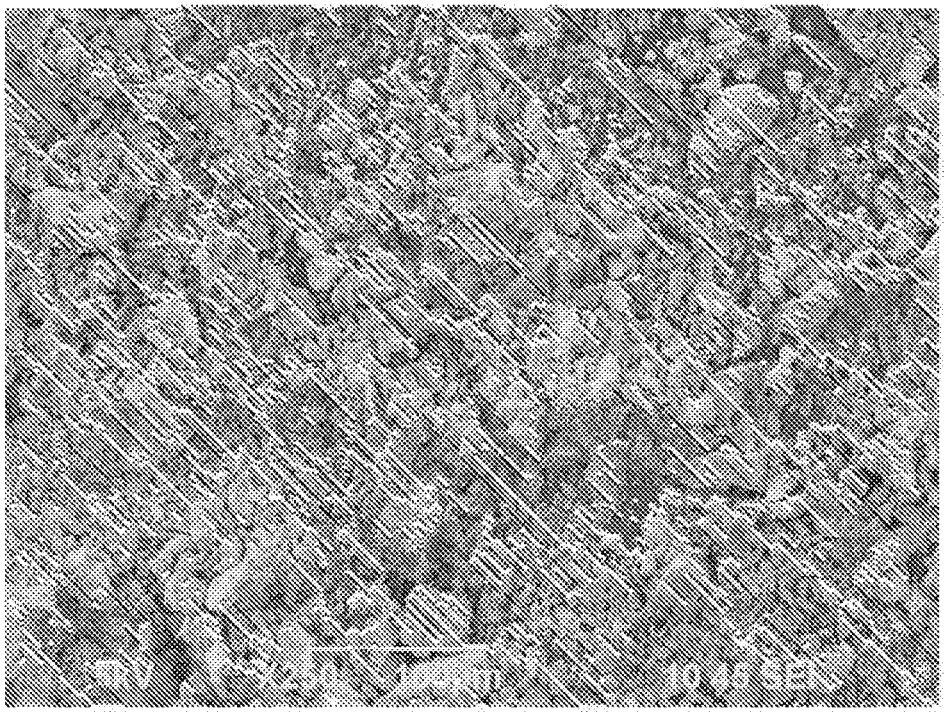
FIG. 1E is a micrograph of exemplary as-received HDH erbium powders (i.e., hydrogen embrittled Er that has been milled/shattered into powder and dehydrogenated)
Figure 1F:
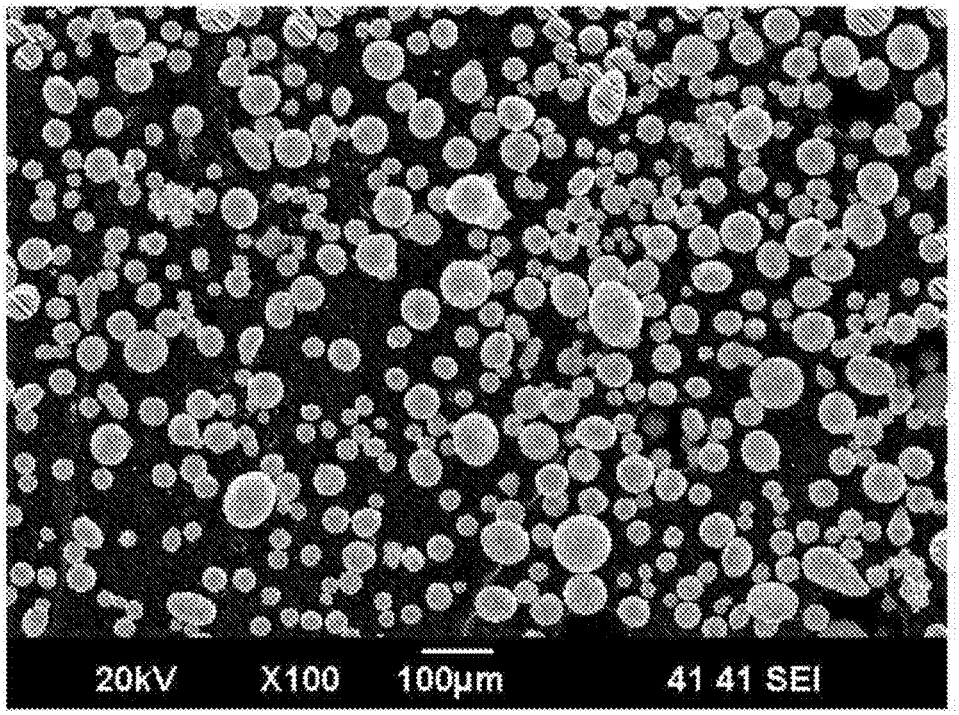
FIG. 1F is an SEM image of exemplary ErFe gas atomized powders before sieving.
Figure 1G:
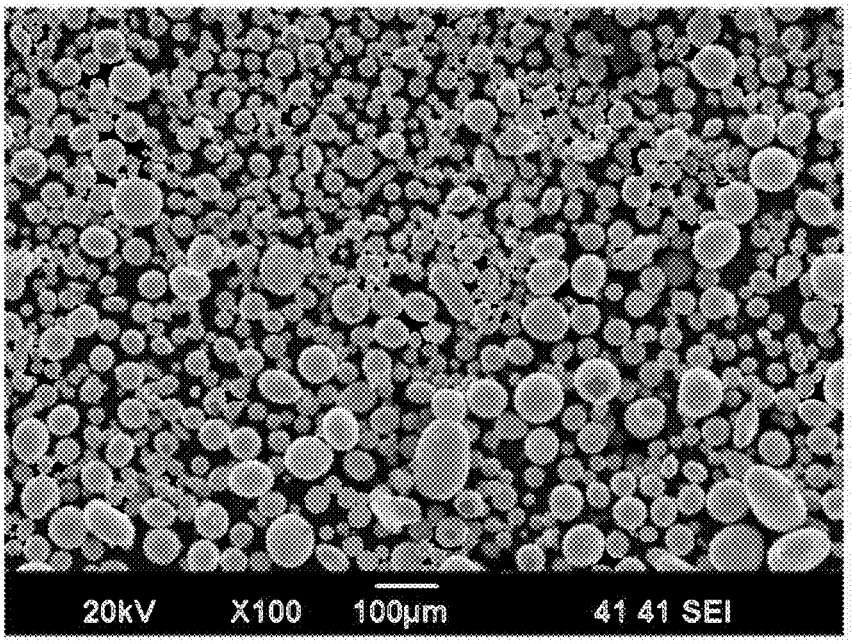
FIG. 1G is an SEM image of exemplary ErAg gas atomized powders before sieving.

Several different types of rare earth element-containing powders can be added to the Ni—Ti powders to form the sintered Ni—Ti-RE alloy. These powders include:

Prealloyed RE-Ni alloy (e.g., ErNi) powders, optionally with B or Fe doping, that may be produced by gas atomization to achieve a fine particle size (see FIGS. 1C and 1D);

High purity elemental RE (e.g., Er) powders, optionally with B or Fe doping, that may be produced by gas atomization to achieve a fine particle size;

Lower purity elemental RE powders (e.g., hydrogenated-dehydrogenated (HDH) RE powders such as HDH Er (see FIG. 1E) that have been further dehydrogenated); and Ductile rare earth intermetallic or alloy (e.g., a rare earth element alloyed with silver or another ductile metal, such as ErAg or ErFe intermetallic) powders (see FIGS. 1F and 1G).

The preceding powders may be obtained from commercial sources or produced using powder production methods known in the art (e.g., gas atomization, ball milling, etc.).

The rare earth element may be Er or another element selected from the group consisting of Dy, Gd, Ho, La, Lu, Sc, Sm, Tb, Tm, Y, and Yb. For example, the rare earth element may be one of the following: Dy, Er, Gd, Tb, and Tm. The use of high purity elemental or doped RE powders in the sintering process may be referred to as "reactive" sintering due to the proclivity of the RE powders to react with Ni. The scavenging of nickel from the Ni—Ti matrix by the RE element may be a downside of reactive sintering using high purity elemental RE powders, since reduced Ni levels may raise the transformation temperatures (e.g., $A_f$) of the alloy to a level at which superelasticity is not obtained at body temperature. This problem may be diminished or avoided altogether by using fully dehydrogenated HDH RE powder or by using prealloyed RE-Ni powders. Full dehydrogenation of HDH Er powders can be achieved by heating the powders in a furnace with at a temperature of about 900° C. under a vacuum of 10-10 bar.

Reactive sintering may be advantageous, however, because the rare earth particles may reduce in size during sintering due to their reaction with the NiTi particles. This may result in either many finer particles replacing the starting rare earth particle or a halo of finer particles surrounding the now smaller initial rare earth particle. If the formation of Ti rich regions within these alloys can be eliminated and the transformation temperatures (e.g., $A_f$) controlled, this route may be very attractive in a production environment, as the ramp rate can be increased (e.g., to about 35° C./min).

A challenge with using prealloyed RE-Ni powders is that, for a given atomic percentage of the rare earth element, a larger percentage of second phase inclusions is obtained than if an elemental rare earth powder is used; this means the superelastic matrix accounts for a smaller proportion of the alloy and the recoverable strain or the upper and lower loading plateaus may be reduced. Using a ductile and radiopaque alloy such as ErAg may be a way around this, but preliminary results indicate that hot working temperatures of less than 760° C. may be needed to prevent the ErAg particles from alloying with the NiTi particles; this in turn may require an increased number of hot working steps to reduce the alloy down to a form that can be cold worked. Besides ErAg, other ductile rare earth intermetallics include yttrium-silver (YAg), yttrium-copper (YCu), dysprosium-copper (DyCu), cerium-silver (CeAg), erbium-silver (ErAg), erbium-gold (ErAu), erbium-copper (ErCu), holmium-copper (HoCu), neodymium-silver (NdAg), (e.g., see Gschneidner Jr. K. A. et al. (2009) "Influence of the electronic structure on the ductile behaviour of B2 CsCl-type AB intermetallics," Acta Materialia 57, 5876-5881, which is hereby incorporated by reference), with some of the intermetallics reported to achieve >20% strain after heat treating and hot rolling.

Hot Hardness Measurements

Hot hardness measurements (hardness measurements conducted at elevated temperatures) can provide information about the softening temperature of a metal or alloy. While specific heats and melting temperatures are recorded in the literature for rare earth metals, no data on the softening temperatures of these elements has been set forth previously. Hot hardness measurements on RE metal specimens are thus employed in the present investigation to identify a softening temperature for each element, which may then be used to determine an appropriate sintering temperature for a Ni—Ti-RE alloy including that element. This procedure is based on the premise that, for a given Ni—Ti-RE alloy, there may be a maximum acceptable sintering temperature that depends on the ternary element and may be generalized to be the softening temperature for that element.

The RE metals that underwent hot hardness testing were selected primarily for their high melting temperatures and high densities, with the exception of Nd, which was chosen for comparison purposes. A high melting temperature and high density are believed to be important for achieving good radiopacity in the sintered alloy and also for reducing the likelihood of network formation during sintering.

Figure 3:
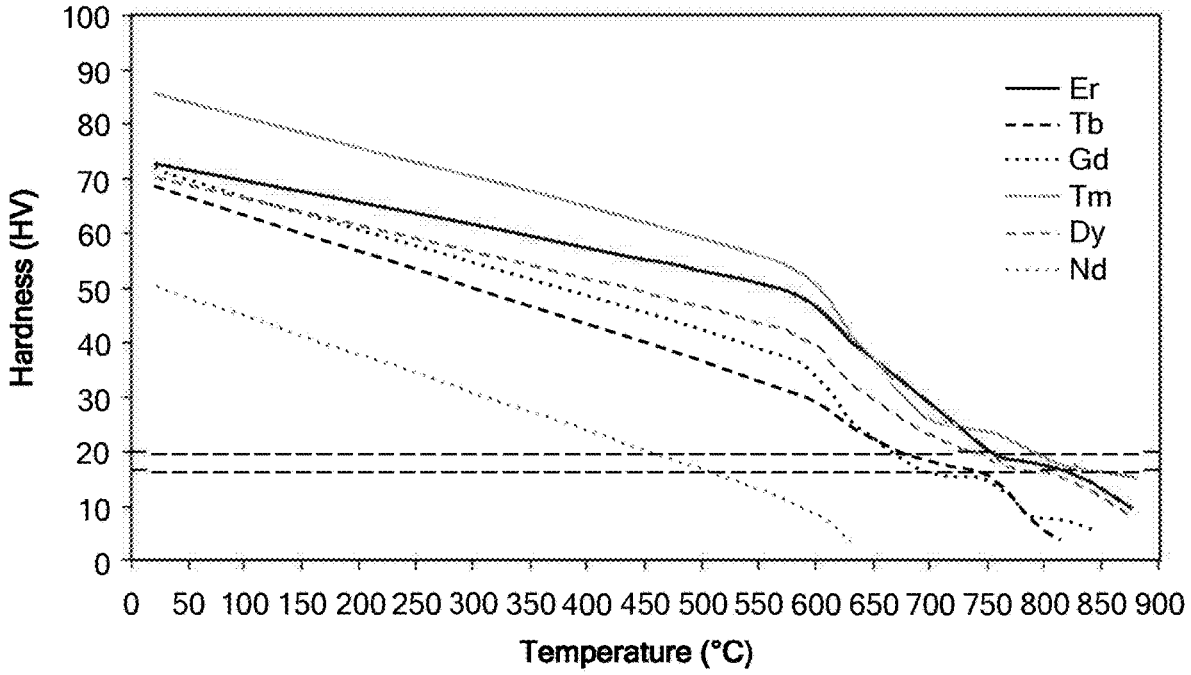
FIG. 3 shows Rockwell (E) hardness as a function of temperature for several rare earth elements.

The hot hardness tests were carried out on a Rockwell hardness tester modified with the addition of an induction heated pedestal with temperature measurement, a radiation pyrometer for sample temperature measurement, and a silicone nitride spherical tip of 3.175 mm (⅛") in diameter embedded in a stainless steel 304 shaft. The specimens were purchased as 6×6×25 mm3 size samples and they underwent hot hardness testing along their 25 mm lengths. During each hardness measurement, an initial load is applied of 10 kg, then a higher load of 150 kg is applied for 10 seconds (Rockwell E scale), then the higher load is removed, and the hardness measurement is taken while back under the lower 10 kg load. This inherent compliance compensating setup produced consistent and repeatable hot hardness results, which are summarized in Table 4 below and in FIG. 3. The hot hardness values descend in the order of the melt temperatures of the rare earth metals (approximately).

TABLE 4

Hot Hardness Values as a Function of Calibrated Temperature

| Calibrated Temperature | Er | Tb | Gd | Tm | Dy | Nd |
|---|---|---|---|---|---|---|
| 20 | 73 | 69 | 72 | 86 | 71 | 51 |
| 569.5 | 50 | 32 | 38 | 55 | 43 | 12 |
| 630.5 | 40 | 25 | 26 | 42 | 33 | 4 |
| 691.5 | 30 | 19 | 17 | 27 | 24 | Fracture |
| 752.4 | 20 | 16 | 15 | 24 | 19 | |
| 782.9 | 18 | 9 | 9 | 21 | 17 | |
| 813.4 | 17 | 4 | 8 | 18 | 16 | |
| 843.9 | 14 | Fracture | 6 | 17 | 13 | |
| 874.4 | 10 | Fracture | 16 | 9 | | |
| Melt temp. (° C.) | 1529 | 1356 | 1312 | 1545 | 1407 | 1024 |
| Density (g/cm$^3$) | 9.066 | 8.23 | 7.9 | 9.32 | 8.54 | 7.01 |

Based on these data and on the melting temperature of each rare earth element, a table of exemplary softening temperature ranges is compiled in Table 5. These temperatures may be used to determine the desired sintering temperature for a Ni—Ti-RE alloy including that particular rare earth element. In addition, softening temperatures for Ni—Ti-RE alloys containing rare earth elements not shown in Table 5 may be obtained as described herein based on melting temperature and/or Rockwell hot hardness data.

TABLE 5

Exemplary Softening Temperature Ranges

| Basis | Range of Values | Corresponding Softening Temperature Range (° C.) Er | Tb | Gd | Tm | Dy |
|---|---|---|---|---|---|---|
| Melting Temp. (Range 1) | 0.45-0.6 $T_m$ | 688-917 | 610-814 | 590-787 | 695-927 | 633-844 |
| Melting Temp. (Range 2) | 0.50-0.55 $T_m$ | 765-841 | 678-746 | 656-722 | 773-850 | 704-774 |
| Hot Hardness (Range 1) | 17-25 Rockwell (E) | 720-820 | 630-745 | 635-700 | 720-860 | 680-800 |
| Hot Hardness (Range 2) | 17-20 Rockwell (E) | 750-820 | 670-745 | 670-700 | 790-860 | 740-800 |

Spark Plasma Sintering Experiments

Before any attempts were made to sinter ternary Ni—Ti-RE alloys, an SPS study was carried out on binary Ni—Ti alloys using gas atomized prealloyed Ni—Ti powder and elemental Ni and Ti powders, as described below in Examples A and B. Prealloyed Ni—Ti powder "A," which is shown in FIG. 1C, was used in some of the experiments and has the following characteristics: d50=48.7 μm, 55.74 wt. % Ni (50.68 at. % Ni), $A_f$=0° C., and hardness 240 Hv. Prealloyed Ni—Ti powder "B," which is shown in FIG. 1D, was used in other experiments and has the following characteristics: d50=18.8 μm, 56.20 wt. % Ni (51.15 at. % Ni), $A_f$=−50° C., and hardness 400 Hv.

In Examples C-H, Er is added to the Ni—Ti powders to form sintered ternary Ni—Ti—Er alloys, each containing about 6 at. % Er. This amount of Er was selected as it is believed to be the minimum amount of the rare earth element needed for a 50% increase in radiopacity over binary NiTi. The examples show the effect of different process conditions—particularly changes in the sintering temperature and temperature ramp rate—on the resulting sintered ternary alloy. Also shown in the examples is the effect of varying the form in which the Er is added to the Ni—Ti powder to be sintered—e.g., as a prealloyed powder or an elemental Er powder. Examples C and D show the effect of heating the powders at a ramp rate of 100° C./min up to a sintering temperature of 900° C. and 835° C. respectively. Examples E-H show the results of heating the powders at lower ramp rates and to lower temperatures. Table 6 below provides a summary of the Examples.

TABLE 6

Summary of Examples

| Ex. | Form of Er addition | Ramp Rate ° C./min) | Sintering Temp. (° C.) | Leakage from die? | Hardness (VHN) | $A_f$ Temp (° C.) | Workability |
|---|---|---|---|---|---|---|---|
| C | Elemental Er (HDH) | 100 | 900 | Yes | 505 | None observed | None |
| D | Elemental Er (HDH) | 100 | 835 | Yes | 400 | 105 | None |
| | $Er_3Ni$, $Er_2Ni$, ErNi, $ErNi_3$ | | | Yes | >400 | None observed | None |
| E | Elemental Er (HDH) | 25 | 835 | No | 330 | 110 | Extrusion only |
| | $Er_3Ni$, $Er_2Ni$, ErNi, $ErNi_3$ | | | No | 210, 280, 335, 550 respectively | >60 | Extrusion only |
| | Elemental Er (Pure) | | | No | 180 | >100 | Extrusion only |

TABLE 6-continued

| Summary of Examples | | | | | | | |
|---|---|---|---|---|---|---|---|
| F | Elemental Er (HDH) | 25 | 800 | No | 333 | 18 | Good |
| G | ErNi | 25 | 800 | No | 302 | 5 | Good |
| H | ErFe | 25 | 760-800 | No | <300 | >100 | Good |
| I | ErAg | 25 | 760-800 | | <300 | 24 | Poor |

| Ex. | Other comments |
|---|---|
| C | Does not form network |
| D | Er alloyed with Ni in NiTi |
| | Forms ErNi around NiTi particles |
| | Formed network |
| | Pooled into large aggolomerates |
| E | Does not form network but reacts with Ni in NiTi |
| | Does not form network but reacts with Ni in NiTi |
| | Network formed |
| F | Does not react with Ni from NiTi |
| | Workability improves when HDH is further dehydrogenated |
| G | Recoverable strain (4%) when hot rolled at 850° C. |
| H | No Network formed |
| I | No Network formed |
| | Poor workability due to oxidation of Ag |
| | Alloy breaks up easily during hot rolling |

EXAMPLE A

SPS at 900° C. and High Ramp Rate—Binary Ni—Ti Alloy

Prealloyed Ni—Ti powder A is added to the 10 mm diameter die of the SPS apparatus in quantities of about 2.5 g at a time and built up in four steps, with a compaction pressure being applied between each 2.5 g addition. The compaction pressure may be over 110 MPa for the initial 2.5 g being compacted, but the pressure is gradually reduced to 90 MPa for the subsequent compactions to prevent the die from bursting. Spring back is evident on unloading, mainly due to the properties of the NiTi powder, but also due to the die swell and general compliance in the SPS machine itself.

In the present study, the best density is obtained for a binary Ni—Ti alloy using a sintering temperature of about 900° C. and a sintering pressure of about 50 MPa. If a higher temperature or pressure is used, flash out at the punch may result. The holding time used is 10 minutes, chosen again for the purposes of achieving the best densification. The ramp rate is approximately 100° C. per minute up to 820° C., and then is reduced significantly, in an incremental fashion, thereafter. A density of greater than 98% is achieved, calculated using a theoretical density of 6.5 g/cm3.

Because reactions between the graphite die and the NiTi powder during sintering may occur, after sintering the first 1 mm of material was removed from the billet to eliminate any possible carbon contamination. An effort was made to keep carbon and oxygen impurity levels low, because their presence can significantly affect the phase transformation behavior. Oxides can also give rise to brittleness and make cold working more difficult. Accordingly, sintering was performed in vacuum. A gas analysis of the billets showed that the oxygen level was much lower than anticipated, at 70 wppm. This is significantly below the stated oxygen level in the starting Ni—Ti rod stock pre-atomization (~300 wppm) and the expected pick during gas atomization (~150 wppm totalling ~450 wppm). Also, the storage time for this powder was three years (oxide increases with time, exponentially decreasing). When heat and pressure are applied to the material during SPS, outgassing takes place on the surfaces of the particles, and this may provide an adequate atmosphere to establish a very fine plasma, resulting in a reduction in the oxygen content.

After sintering, the binary Ni—Ti alloy exhibits a one-step transformation on heating and cooling and the $A_f$ temperature is 18° C., as determined by differential scanning calorimetry (DSC). After two extrusion passes and annealing at 550° C. for 15 minutes, the DSC peaks are very sharp on heating and cooling and the $A_f$ temperature has further reduced to 9° C.

EXAMPLE B

SPS at 900° C./850° C. at High Ramp Rate—Binary Ni—Ti Alloy

The elemental powders of Ni and Ti are mixed equiatomically, with the as-received Ti powder being sieved to 20 microns in size prior to mixing to improve the final microstructure. The sintering processes of this example are carried out at a sintering pressure of 50 MPa and at a sintering temperature of 900° C. for 10 minutes or 850° C. for 1 minute. The ramp rate is approximately 100° C. per minute up to 820° C., and then drops significantly, in an incremental fashion, thereafter. The sintering is performed in vacuum also. Scanning electron microscopy (SEM) images show that, for a sample sintered at 850° C. for 1 minute, elemental Ti still remains, even after the sieving.

A gas analysis was carried out according to ASTM E1019-08 and the results show that the carbon level in the SPS billet was 0.06 at. %, which is within the acceptable level set by the ASTM standard. The oxygen content measured 0.007 at. %, which is far less than that of commercially melted Ni—Ti alloys. Considering the purity of the starting powders (99.9 at. %) and the fact that the mixing was done in a ball mill without any special precautions to prevent oxidation, this is a remarkably low level of oxygen, perhaps due to the nature of SPS. A reaction between the graphite die and the NiTi powder during sintering is possible with the standard SPS setup and may well affect the alloy composition. With the removal of 0.5 mm of NiTi material from the sintered billet diameter, the risk that any carbon contamination may affect the properties of the bulk material is eliminated.

Based on density and hardness data combined with microstructural observations, the optimal sintering temperature is determined to be 900° C. for 10 minutes with a pressure of 50 MPa. If a higher temperature or pressure is used, the metal may flash out at the punch. The amount of time the binary Ni—Ti sample is held at the optimal 900° C. sintering temperature is an important SPS parameter, as shorter sintering times produced samples with far poorer tensile properties, and samples sintered at 850° C. for 10 minutes also had unsatisfactory tensile properties.

Both the as-sintered and extruded NiTi, using the optimal sintering parameters identified above, showed well-defined transformation peaks in DSC upon cooling and heating, similar to those of melt-cast NiTi alloys. On the other hand, the transformation temperatures of the billet sintered at 850° C. prior to and following extrusion showed weak endothermic and exothermic peaks.

EXAMPLE C

SPS at 900° C. with High Ramp Rate—Ni—Ti—Er Alloy

Erbium metal is very soft (70 HV) in its pure state (>99.5%) and is difficult to safely convert into metal powder, even with expensive milling aids. Hence most or all of the rare earth metal powders sold on the market today have been hydrogen embrittled, milled and then dehydrogenated. Dehydrogenation, which typically involves heating the metal up to 900° C. under high vacuum conditions, can be expensive; consequently, the process may not be performed under the optimal settings of temperature, vacuum and time. The starting powders were therefore analyzed for contaminants, and the results showed the HDH Er powder was high in O, H and N. Since at the time no purer rare earth powder could be obtained, the HDH ("hydrogenated-dehydrogenated") powder (see FIG. 1E) was sintered along with gas atomized prealloyed Ni—Ti powder A into a Ni—Ti-6 at. % Er alloy billet for assessment.

When SPS parameters identical to the binary Ni—Ti sintering parameters (i.e., 900° C. sintering temperature and a 10 minute hold at this temperature, with a ramp rate of approximately 100° C. per minute up to 820° C., followed by an incrementally reduced rate thereafter) are used to form a ternary Ni—Ti-6 at. % Er microstructural analysis indicates that no interparticle network forms. DSC of the powder shows no thermally induced phase changes, and that the hardness is very high at 505 HV. Energy dispersive x-ray (EDX) analysis shows that the Er forms an $Er_xNi_y$ phase, thus scavenging nickel from the Ni—Ti alloy matrix and increasing the transformation temperatures (e.g., $A_f$).

Mixing the 6 at. % HDH Er powder with 6 at. % Ni powder prior to mixing with the prealloyed Ni—Ti powder A, before sintering the mixture at 900° C. for 10 minutes still does not produce a sintered sample showing any thermally induced phase changes. Large agglomerates of an $Er_xNi_y$ phase were found in the alloy, along with some evidence that the erbium or erbium alloy was forming an interparticle network. The oxygen level of the specimen was found to be very high at 4230 wppm, although the hydrogen level was not measured.

In a similar experiment, 6 at. % HDH Er powder was added to 50 at. % Ni powder and 44 at. % Ti powder, and then the mixture was sintered at 900° C. for 10 minutes. While Ni-rich NiTi did form, larger Ti particles diffused into the matrix and a Ni-rich $Er_xNi_y$ compound formed within the matrix. The hardness was also very high at 542 HV.

In summary, when the HDH Er powder was added to either the binary prealloyed Ni—Ti powder or the elemental Ni and Ti powders and then sintered at 900° C. for 10 minutes (as had been successfully done to form a sintered binary Ni—Ti alloy), a sintered Ni—Ti—Er alloy with disadvantageous microstructure and properties resulted. In both cases, the Er particles alloyed with Ni. When the prealloyed Ni—Ti powders were used, the HDH Er particles apparently melted and alloyed with Ni from the NiTi to form an $Er_xNi_y$ phase, which in some cases would run out of the die. The apparent cause of the alloying when the HDH Er particles were sintered with the elemental Ni and Ti powders was a far stronger bond between erbium and nickel than between titanium and nickel; as a result, many elemental Ti particles were present after sintering along with many Ni-rich $Er_xNi_y$ compounds. Hot working results on this set of alloys also proved unfavorable.

All of the Ni—Ti—Er alloys sintered at the high temperature of 900° C. proved extremely difficult to extrude. Adding Boron (B) to the powder mixture can improve ease of extrusion. For example, when elemental B was added to the prealloyed Ni—Ti powder A including 6 at. % HDH Er and the 6 at. % Ni in the form of NiB, $ErB_4$ and elemental Er, hardness testing results suggested that $ErB_4$ shows the best result in reducing hardness, while elemental boron contributes to a hardness reduction only at higher wppm levels.

EXAMPLE D

SPS at 835° C. with High Ramp Rate—Ni—Ti—Er Alloy

When HDH Er was sintered along with prealloyed Ni—Ti powders A at a moderate temperature of 835° C. and at 60 MPa, using a similar ramp rate to the previous 100° C./min rate, it seems that the Er continued to alloy with the Ni from the prealloyed Ni—Ti powders. The result was that the $A_f$ temperature of the sintered alloy was unacceptably high.

When adding the erbium as an erbium-nickel compound with different erbium to nickel ratios (e.g., ErNi, $Er_2Ni$, $Er_3Ni$ and $ErNi_3$) Er from the compound still seemed to alloy with the Ni from the prealloyed Ni—Ti powders, and in some cases an $Er_xNi_y$ compound ran out of the SPS die and punch as liquid metal.

In moderate sintering temperature (835° C.) trials using a high temperature ramp rate (100° C. per minute) even the highest melting temperature compound ($ErNi_3$, with a melting temperature of 1254° C.) melted and exited the SPS die.

EXAMPLE E

SPS at 835° C. and Reduced Ramp Rate—Ni—Ti—Er Alloy

It is believed that the rare earth elements (erbium or $Er_xNi_y$ compounds in this case) heat faster than NiTi, mainly due to the lower specific heats of the rare earth elements (e.g., 170 J/kg° C. for Er, versus 620 J/kg° C. for NiTi, which is ~4 times higher). Since the resistivity of the rare earth elements and NiTi are not significantly different, the effect of resistivity is assumed to be minimal.

It has been found that at lower ramp rates all of the $Er_xN_{ty}$ compounds remain stable during sintering. In an embodiment of the method of forming a sintered Ni—Ti-RE alloy according to the present invention, the sintering temperature used was 835° C., and the pressure was 60 MPa. The temperature ramp rate was 25° C./min. For example, $ErNi_3$ particles were sintered with prealloyed Ni—Ti powder A at 835° C. and 60 MPa, and the $ErNi_3$ remained stable during the process. After sintering, the Ni—Ti—Er alloy was successfully extruded three times at 835° C. to form 0.6 mm wire, although the wire was fairly brittle due to large inclusions of $ErNi_3$.

To eliminate the presence of large inclusions in the sintered alloy, the starting powders were passed through a 20 micron sieve prior to further sintering trials. Sintered alloys were then formed using sieved prealloyed Ni—Ti powder A mixed separately with (a) sieved HDH Er; (b) sieved $Er_3Ni$; (c) sieved $Er_2Ni$; and (d) sieved ErNi. The Er phases remained stable in each case and the sintered billets exhibited different degrees of brittleness.

Figure 4:
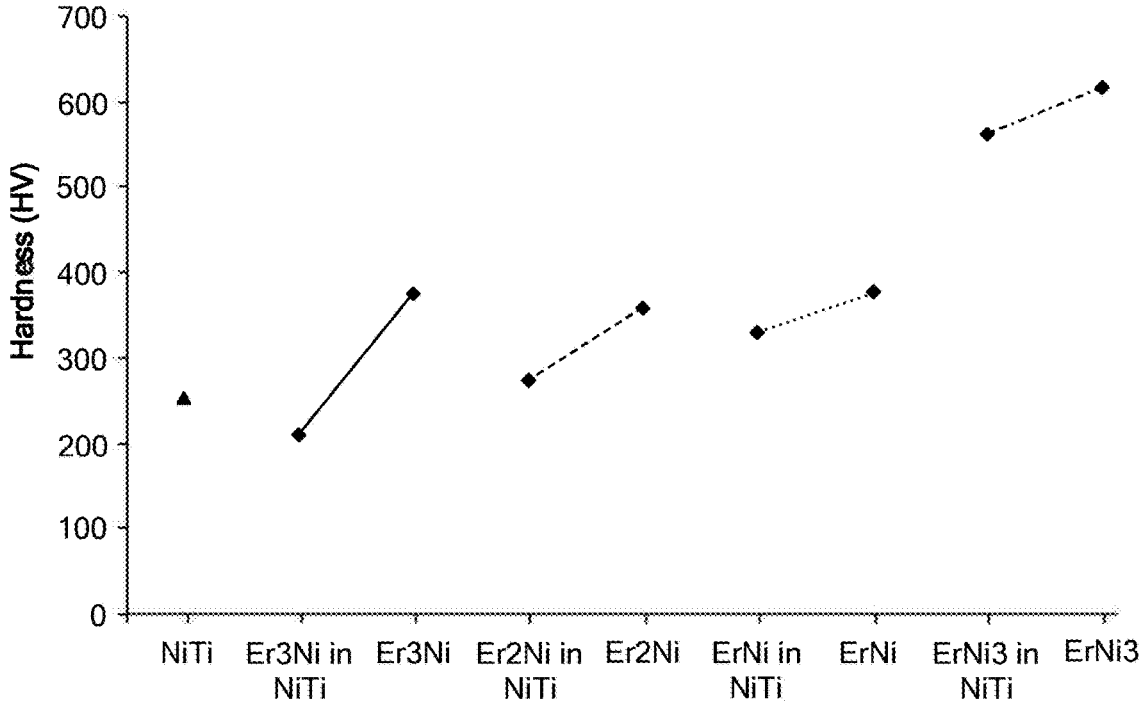
FIG. 4 shows hardness data for several RExNiy second phase compounds and for the compounds in a Ni—Ti matrix, where x and y are integers of 1 or greater.

Referring to FIG. 4, hardness data indicate that second phase compounds including higher levels of Er hardened the NiTi matrix the least; in fact, $Er_3Ni$ and HDH Er softened the NiTi below its binary value. Generally, extrusion of the ternary SPS-processed Ni—Ti—Er billets resulted in a reduction of the $A_f$ temperature compared to the as-sintered state, although the values remained above body temperature.

EXAMPLE F

SPS at 800° C. and Reduced Ramp Rate—Ni—Ti—Er Alloy

The combination of reducing the sintering temperature to 800° C. and the use of prealloyed Ni—Ti powder B mixed with HDH Er allows the $A_f$ transformation temperature of the SPS ternary Ni—Ti—Er alloy to be controlled to below body temperature. In conjunction with the reduced sintering temperature, the pressure during sintering was increased to 70 MPa to achieve a density of >95%. The temperature ramp rate was 25° C. per minute.

Figure 5A:
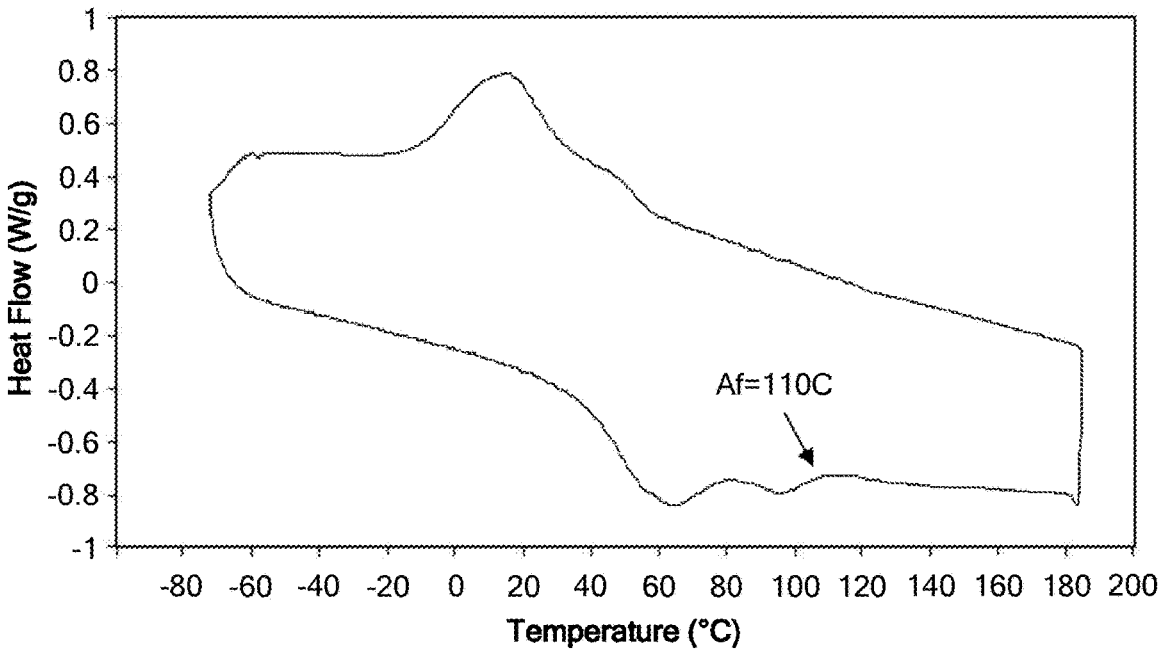
FIGS. 5A and 5B show differential scanning calorimetry (DSC) data for (FIG. 5A) sieved prealloyed Ni—Ti powder A mixed with sieved HDH Er powder and SPS processed at 835° C., and (FIG. 5B) prealloyed Ni—Ti powder B mixed with HDH Er powder and SPS processed at 800° C.
Figure 5B:
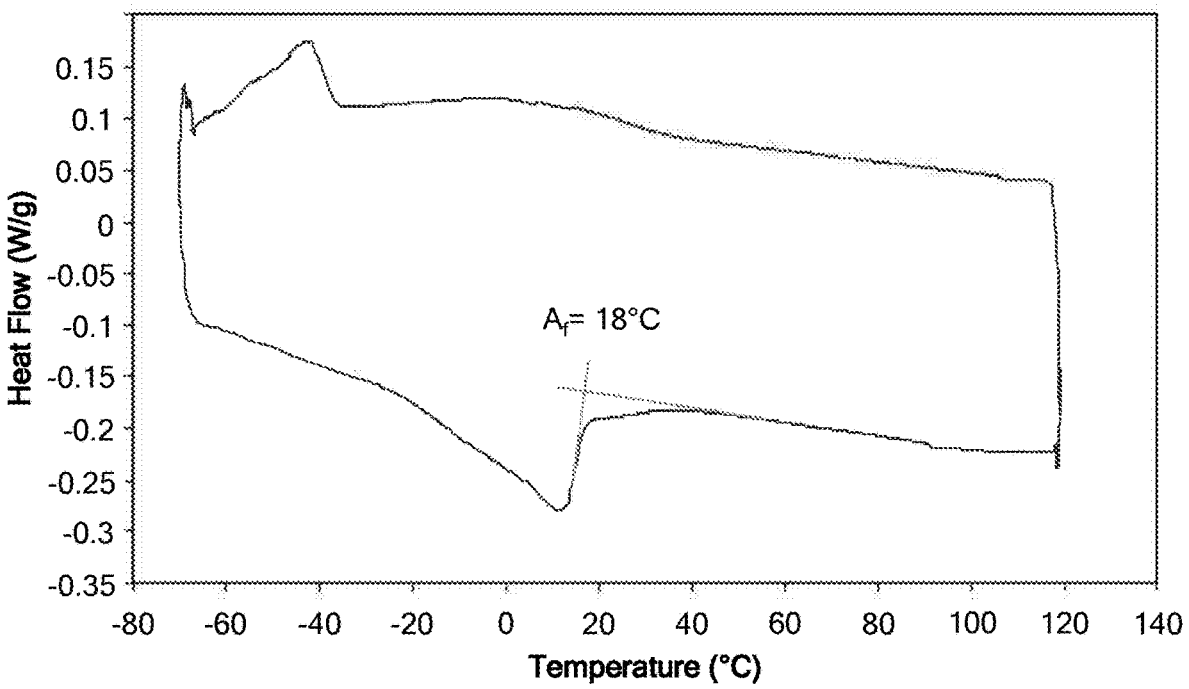

A comparison of the $A_f$ transformation temperatures, measured with differential scanning calorimetry (DSC), can be made between the (a) sieved prealloyed Ni—Ti powder A mixed with sieved HDH Er and SPS processed at 835° C., and the (b) prealloyed Ni—Ti powder B mixed with HDH Er and SPS processed at 800° C., as shown in FIGS. 5A and 5B, respectively. The extra nickel in the prealloyed Ni—Ti powder B, in combination with the lower sintering temperature, has the effect of reducing the $A_f$ transformation temperature to an acceptable level (about 18° C., which is well below body temperature).

The hardness of the sintered Ni—Ti—Er alloy was 333 HV, and SEM/EDX analysis showed that the HDH Er particles did not alloy with the nickel in the prealloyed Ni—Ti powder B, since alloying did not occur at a sintering temperature of 835° C. After sintering, the alloy was hot rolled at a temperature of 800° C. It proved workable through 11 rolling passes, up to a reduction of 28.5% in height, after which the alloy broke apart. The breaks were assumed to be due to the Er particles joining together or to the high hydrogen level in the alloy.

Figure 5C:
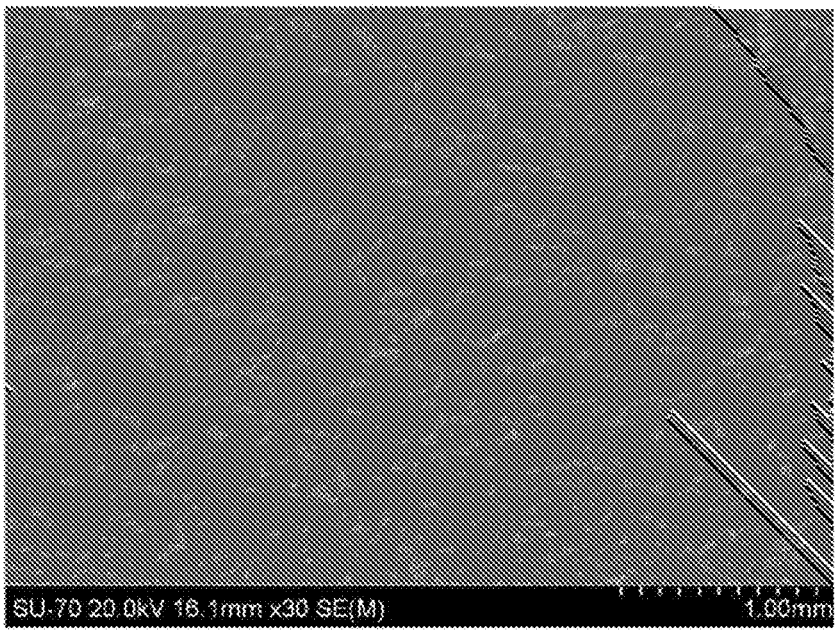
FIG. 5C is an SEM image of a sample sintered at 800° C. from prealloyed Ni—Ti powder B mixed with HDH Er (dehydrogenated for 4 days at 690° C.)
Figure 5D:
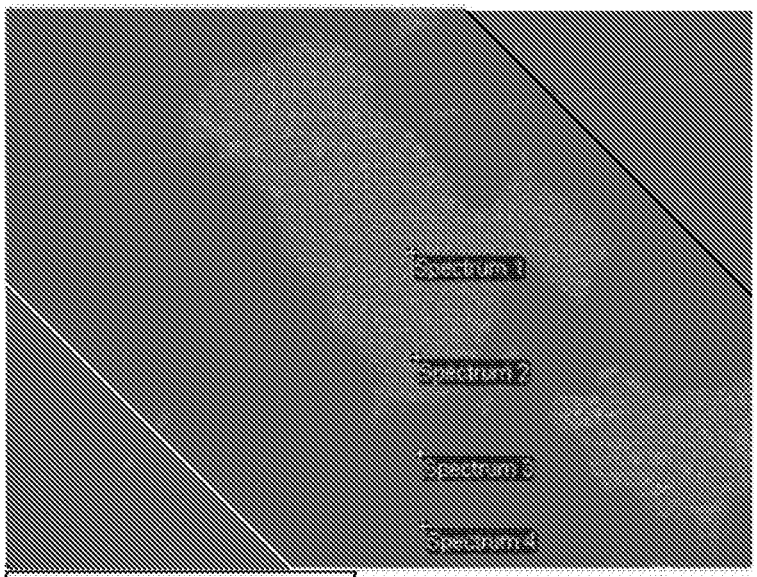
FIG. 5D is an SEM image of the sintered alloy shown in FIG. 5C and corresponding energy dispersive x-ray spectroscopy (EDX) data from different regions of the specimen.
Figure 5E:
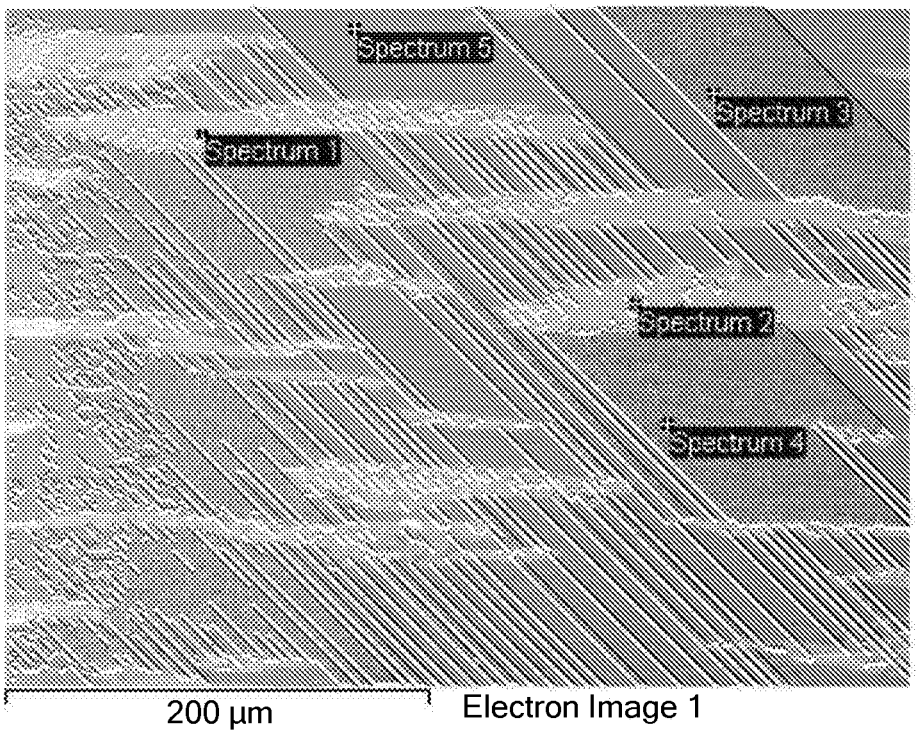
FIG. 5E is an SEM image of the sintered alloy of FIG. 5C after rolling at 850° C. and corresponding EDX data from different regions of the rolled specimen.

Improved hot working results were obtained when an HDH Er powder that underwent dehydrogenation for 4 days at 690° C. was used for sintering with the prealloyed Ni—Ti powder B as described above. The microstructure of the resulting sintered alloy is shown in the SEM images of FIGS. 5C and 5D. In this case, the resulting sintered alloy hot rolled easily at 850° C. from 3 mm in thickness to 1 mm in thickness. The microstructure of the hot rolled alloy is shown in the SEM image of FIG. 5E.

EXAMPLE G

SPS at 800° C. and Reduced Ramp Rate—Ni—Ti—Er Alloy

Figure 6A:
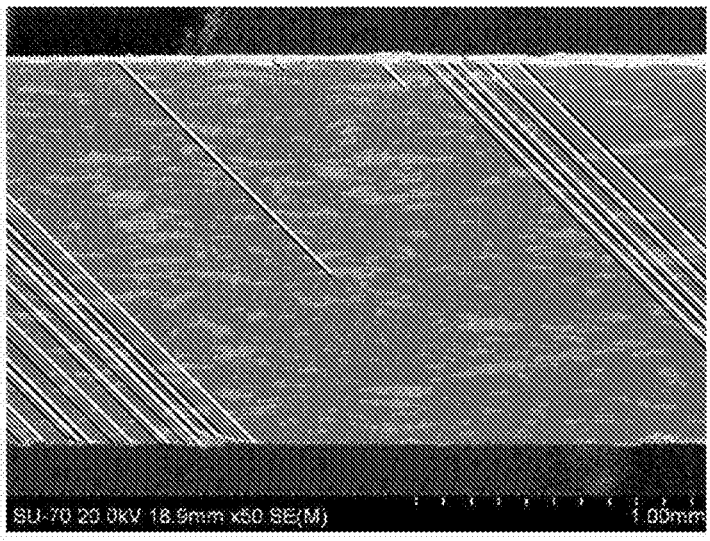
FIG. 6A is an SEM image of a longitudinal section of a sample sintered from prealloyed Ni—Ti powder A+ErNi powder and hot rolled at 850° C. to 1.35 mm in thickness.
Figure 6B:
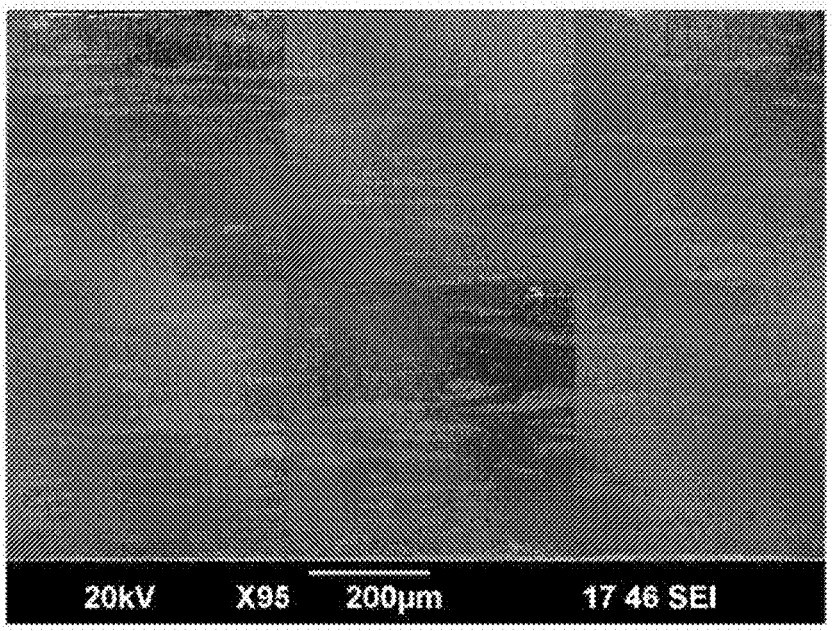
FIG. 6B is an SEM of a longitudinal section of a sample sintered from prealloyed Ni—Ti powder A+ErNi powder and hot rolled at 880° C. to 0.89 mm in thickness.
Figure 6C:
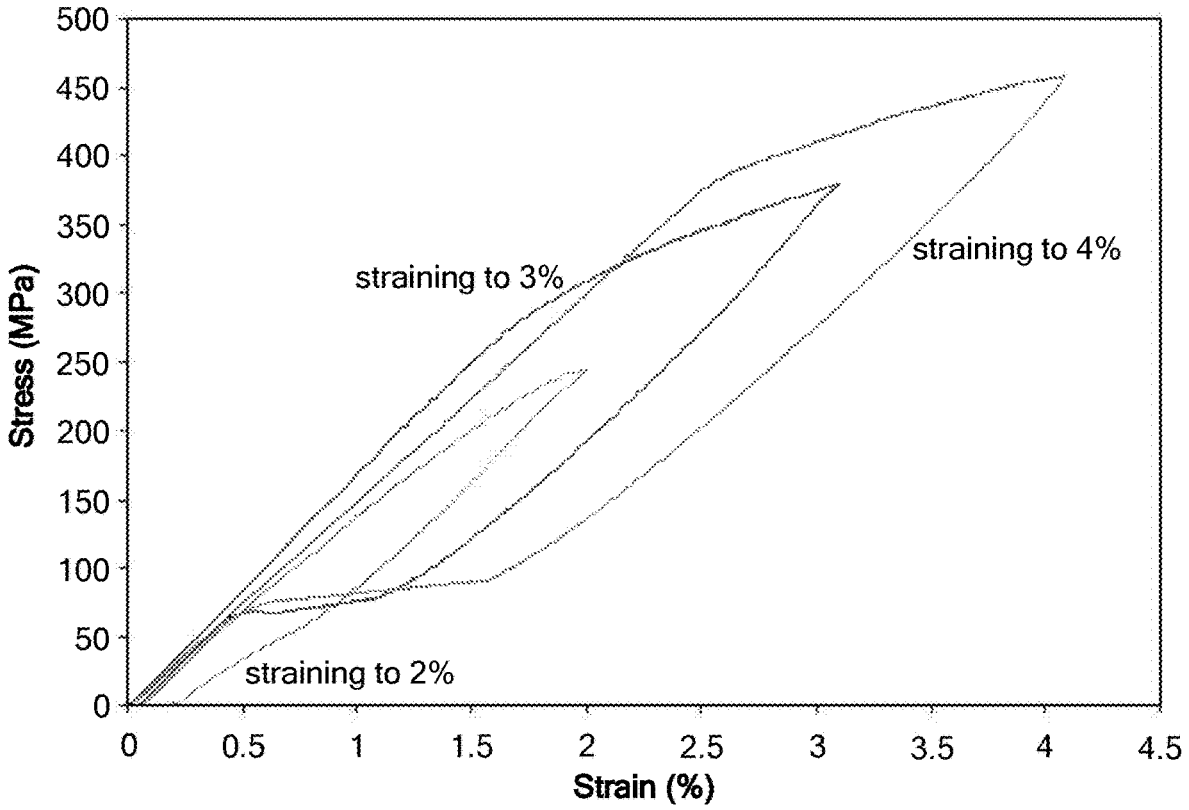
FIG. 6C shows tensile test data from the Ni—Ti—Er specimen shown in FIG. 6A.

Prealloyed Ni—Ti powder A was mixed with prealloyed ErNi powders (both without sieving) and SPS processed at 800° C. with a pressure of 100 MPa and a temperature ramp rate of 25° C. per minute. Referring to FIG. 6A, the sample was hot rolled successfully at 850° C. to a height reduction of beyond 30% without any cracking whatsoever. The rolled material was first removed from its "can" at 1.35 mm in thickness (55% reduction in height). During tensile testing, the material proved to be superelastic, as shown in FIG. 6C. The first straining to 2% resulted in a permanent offset on unloading of ~0.2% strain. This can be considered a pre-strain. The subsequent straining to 3% and 4% strain resulted in almost fully recoverable strain. The upper loading plateau progressively increased during each cycle, for reasons that are not fully understood. As shown in FIG. 6B, the SPS processed material was also successfully hot rolled at 880° C. to a thickness of 0.89 mm.

DSC analysis of the alloy sintered at 835° C. as described above in Example E (sieved prealloyed Ni—Ti powder A mixed with sieved ErNi powders before sintering) revealed an $A_f$ temperature of 0° C. for this specimen. By sintering the prealloyed Ni—Ti powder A+ErNi powders together (both without sieving) at 800° C., the $A_f$ temperature did not change significantly. It also did not change significantly after hot rolling. DSC indicates that the material has a stable $A_f$ of around 3° C.±4° C.

EXAMPLE H

SPS at 800° C./760° C. and Reduced Ramp Rate—Ni—Ti—Er—Fe Alloy

Figure 7A:
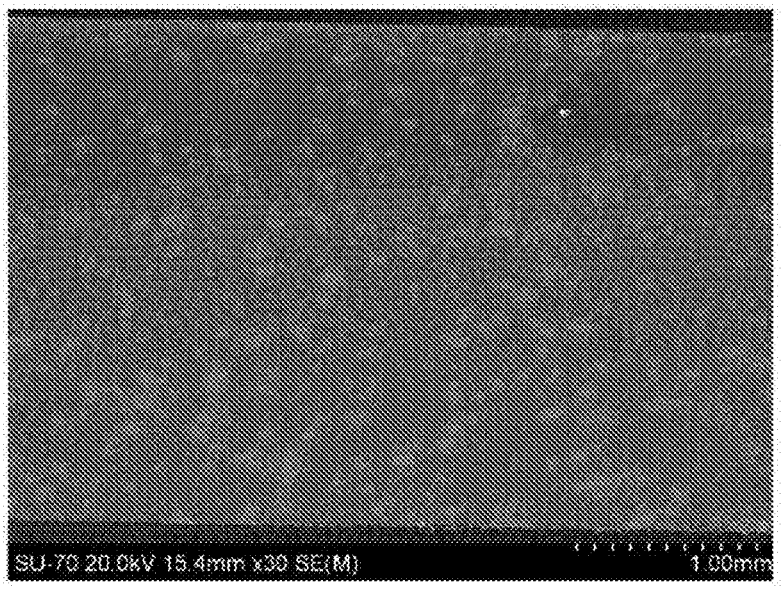
FIG. 7A shows an SEM image of prealloyed Ni—Ti-powder B+ErFe powder after sintering at 800° C. and 85 MPa.
Figure 7B:
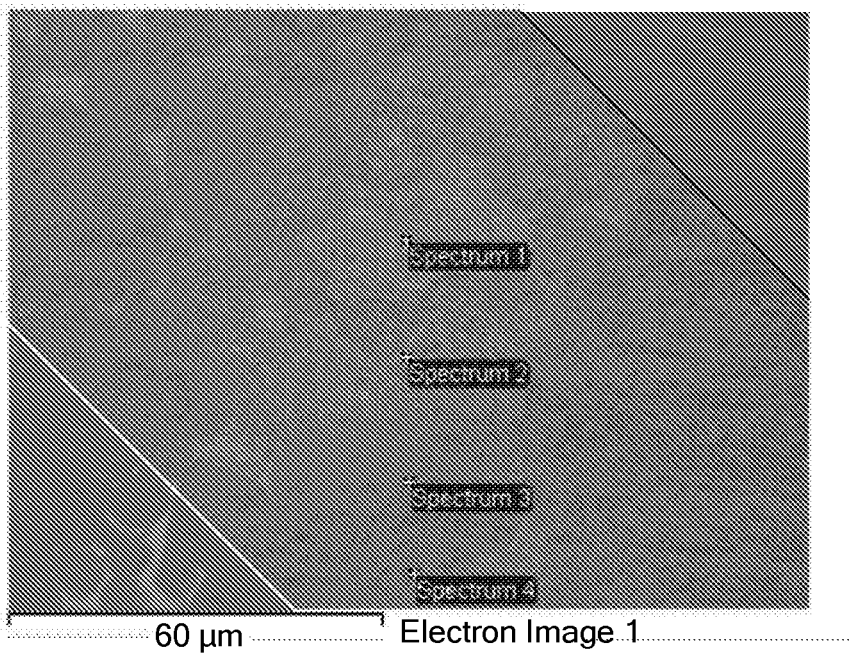
FIG. 7B shows an SEM/EDX image of Ni—Ti powder B+ErFe powder after sintering at 800° C. and 85 MPa.
Figure 7C:
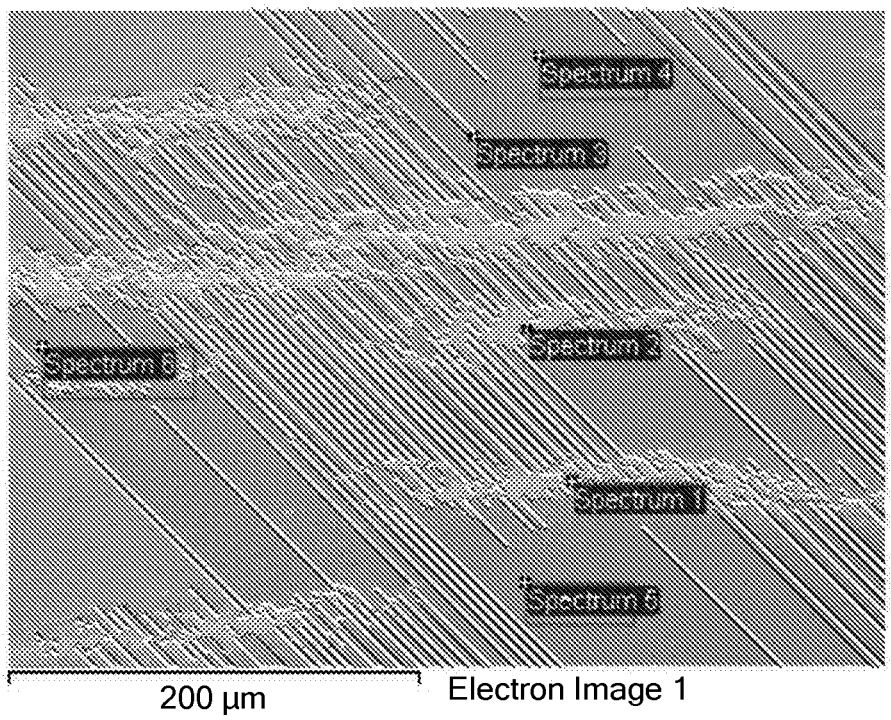
FIG. 7C shows an SEM/EDX image of Ni—Ti powder B+ErFe powder after sintering at 760° C. and hot rolling at 760° C.

An ErFe powder (see FIG. 1F) was mixed with prealloyed Ni—Ti powder A and sintered at 800° C. and 760° C., as shown in FIGS. 7A-7C. A 25° C. per min ramp rate was employed. The results were surprising, where a halo of finer Er-rich particles formed around the original ErFe particles at both sintering temperatures.

Hot rolling at 800° C. of the samples sintered at 800° C. resulted in a ≤66% height reduction before failure. The failure may be due to the formation of very fine Ti-rich particles that surround the Er-rich phase. The volume of these Ti rich particles increased with time at the hot rolling temperature, and the particles begin to merge after 66% height reduction. Referring to FIG. 7C, the sample sintered and hot rolled at 760° C. produced superior results, comparable to that of binary NiTi. The halo effect observed after sintering was still present after hot rolling. The sample was hot rolled from 3 mm to 1.3 mm in thickness (sample height), which equates to a 56% height reduction or a 100% length increase from 25 mm to 50 mm in length. The part appeared to be perfect throughout, without flaws. The material was then cold rolled to 0.35 mm in thickness, keeping the reduction per pass to within 8%. The part was interpass annealed at 760° C. for 5 minutes between passes. Again, the sample was in perfect condition throughout, without flaw.

Figure 7D:
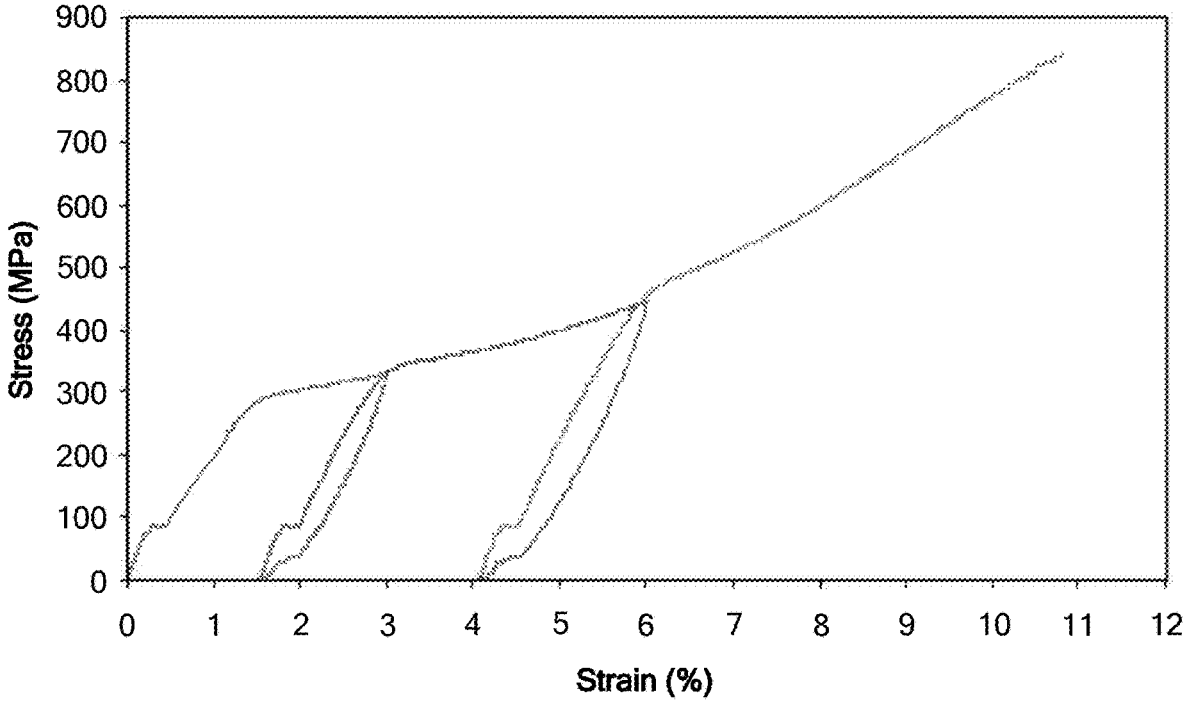
FIG. 7D shows tensile test data from the Ni—Ti—Er—Fe sample of FIG. 7C after cold rolling.

The cold rolled sample was sectioned for DSC and tensile testing. DSC analysis showed the material was in its martensitic state at room temperature as the $A_f$ temperature was at 100° C. The $A_f$ temperature was high, this may have been due to the huge Ni depletion from the matrix that took place during sintering and processing where Er formed into ErNi. While the transformation temperature was too high for superelasticity at room temperature (or body temperature), a tensile test was performed to establish a strain to failure. The sample was loaded to 3% strain and unloaded, then loaded to 6% strain and unloaded, and finally loaded to failure, as shown in FIG. 7D. No recoverable strain was obtained, as expected, but the test data reveal loading and unloading plateaus, and the specimen reached 11% strain before failure. The microstructural analysis of the 0.35 mm cold rolled sample showed good refinement in the microstructure following cold rolling, and optical micrographs showed that the specimen is substantially oxide free.

EXAMPLE I

SPS at 800° C./760° C. and Reduced Ramp Rate of Ni—Ti—Er—Ag

Figure 8A:
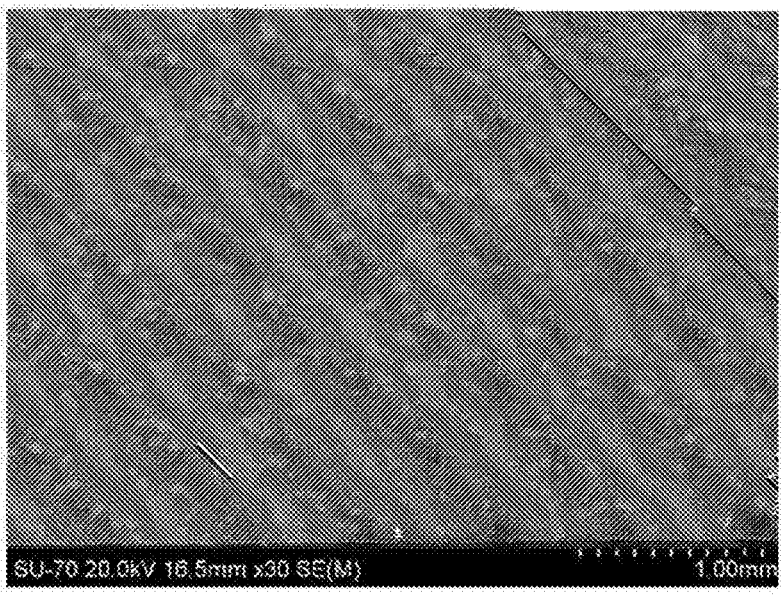
FIG. 8A shows an SEM image of prealloyed Ni—Ti-powder A+ErAg powder after sintering at 760° C. and 85 MPa.
Figure 8B:
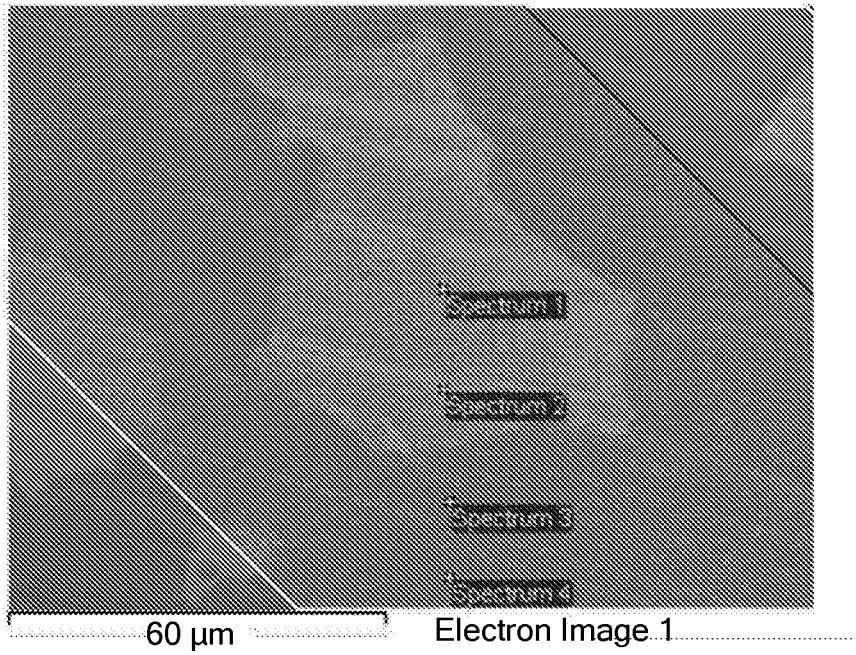
FIG. 8B shows an SEM/EDX image of prealloyed Ni—Ti-powder A+ErAg powder after sintering at 760° C. and 85 MPa.

Prealloyed Ni—Ti powder B was sintered with ErAg powders (see FIG. 1G) at 800° C. and 760° C., following a 25° C. per minute ramp rate. The ErAg compound was stable during sintering up to 800° C.; at or above 800° C., the ErAg particle stoichiometry seemed to become slightly Ag rich. This did not occur when a sintering temperature of 760° C. is used. SEM images showing the microstructure of the sample sintered at 760° C. are shown in FIGS. 8A and 8B.

Figure 8C:
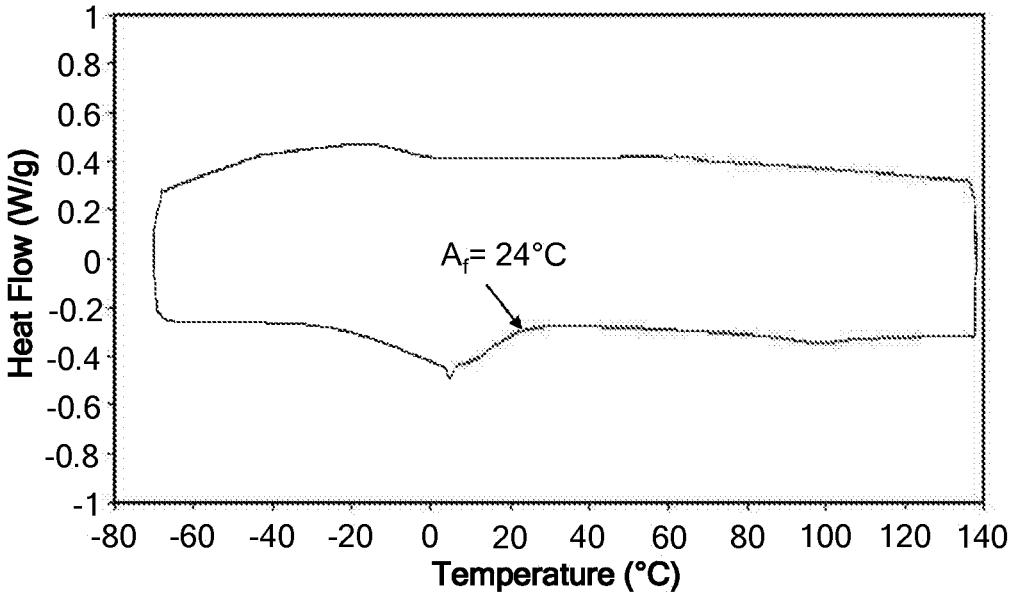
FIG. 8C shows DSC data for the Ni—Ti—Er—Ag sample sintered at 760° C. and 85 MPa.

DSC testing of a sintered Ni—Ti—Er—Ag sample prepared from ErAg mixed with prealloyed Ni—Ti powder A and sintered at 760° C. and 85 MPa, proved favorable, showing an $A_f$ of 24° C., as shown in FIG. 8C. The sintered samples began to breakup during hot rolling at both 760° C. and 800° C. While greater than 50% reductions were possible without any cracking at sintering and rolling temperatures of 760° C., further reductions resulted in crack propagation from the surface. Ti rich regions also appear to begin to form in the alloy at 760° C. These preliminary results establish that an ErAg compound can be sintered along with Ni—Ti prealloyed powders to form a Ni—Ti—Er—Ag alloy successfully. The results also highlight that a hot rolling temperature of less than 760° C. may be needed to avoid destabilizing the ErAg and NiTi components during processing.

A method of forming a sintered nickel-titanium-rare earth (Ni—Ti-RE) alloy comprises: adding one or more powders comprising Ni, Ti, and a rare earth constituent to a powder consolidation unit comprising an electrically conductive die and punch connectable to a power supply; heating the one or more powders at a ramp rate of about 35° C./min or less to a sintering temperature; applying pressure to the powders at the sintering temperature; and forming a sintered Ni—Ti-RE alloy, wherein (a) the sintered Ni—Ti-RE alloy is formed at the sintering temperature, and/or (b) the ramp rate is about 25° C./min, and/or (c) the rare earth constituent is Er, and the sintering temperature is between about 750° C. and about 800° C.; and/or (d) the pressure during sintering can be increased to compensate for a reduction in sintering temperature; and/or (e) an average particle size of the powders can be decreased to compensate for a reduction in sintering temperature; and/or (f) the sintered Ni—Ti-RE alloy comprises: Ni at a concentration of from about 35 at. % to about 65 at. %; Ti at a concentration of from about 35 at. % to about 65 at. %; and the rare earth constituent at a concentration of from about 1.5 at. % to about 15 at. %.

A sintered nickel-titanium-rare earth (Ni—Ti-RE) alloy comprises: Ni at a concentration of from about 35 at. % to about 65 at. %; Ti at a concentration of from about 35 at. % to about 65 at. %; and a rare earth (RE) constituent at a concentration of from about 1.5 at. % to about 15 at. %, wherein the sintered Ni—Ti-RE alloy includes a matrix phase and a second phase, the second phase comprising discrete regions in the matrix phase and including a RE element; wherein (a) the Ni—Ti-RE alloy includes an additional alloying element M selected from the group consisting of: Zr, Nb, Mo, Hf, Ta, W, Re, Ru, Rd, Pd, Ag, Os, Ir, Pt. Au, Mg, Ca, Sr, Ba, Sc, Ti, V, Cr, Mn, Fe, Co, Ni, Cu, Zn, Al, rare earth elements, and Y; and/or (b) the additional alloying element M is selected from the group consisting of Fe and Ag; and/or (b) the second phase includes the additional alloying element M.

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein. Furthermore, the advantages described above are not necessarily the only advantages of the invention, and it is not necessarily expected that all of the described advantages will be achieved with every embodiment of the invention.

It is to be understood that the different features of the various embodiments described herein can be combined together. It is also to be understood that although the dependent claims are set out in single dependent form the features of the claims can be combined as if the claims were in multiple dependent form.

The invention claimed is:

1. A sintered nickel-titanium-rare earth (Ni—Ti-RE) alloy comprising:

Ni at a concentration of from 35 at. % to 65 at. %;

Ti at a concentration of from 35 at. % to 65 at. %; and a rare earth (RE) constituent at a concentration of from 1.5 at. % to about 15 at. %, wherein the sintered Ni—Ti-RE alloy includes a matrix phase and a second phase, the second phase comprising discrete regions in the matrix phase and including a RE element, and wherein the sintered Ni—Ti-RE alloy is superelastic at body temperature.

2. The sintered Ni—Ti-RE alloy of claim 1, wherein the alloy further comprises an additional alloying element selected from the group consisting of Al, Cr, Mn, Fe, Co, Cu, Zn, Ga, Ge, Zr, Nb, Mo, Tc, Ru, Rh, Pd, Ag, Cd, In, Sn, Sb, Hf, Ta, W, Re, Os, Ir, Pt, Au, Hg, Tl, Pb, Bi, Po, and V.

3. The sintered Ni—Ti-RE alloy of claim 2, wherein the second phase has a formula $M_xRE_y$, where M is the additional alloying element.

4. The sintered Ni—Ti-RE alloy of claim 2, wherein the additional alloying element is selected from the group consisting of Fe and Ag.

5. The sintered Ni—Ti-RE alloy of claim 1, wherein the second phase has a formula $RE_xNi_y$.

6. The sintered Ni—Ti-RE alloy of claim 1, wherein the rare earth element is selected from the group consisting of Dy, Er, Gd, Ho, La, Lu, Sc, Sm, Tb, Tm, Y, and Yb.

7. The sintered Ni—Ti-RE alloy of claim 6, wherein the rare earth element comprises erbium.

8. The sintered Ni—Ti-RE alloy of claim 1 further comprising boron (B).

9. The sintered Ni—Ti-RE alloy of claim 1, wherein the matrix includes NiTi.

10. The sintered Ni—Ti-RE alloy of claim 1, wherein the discrete regions of the second phase have an average size from 1 micron to 500 microns.

11. The sintered Ni—Ti-RE alloy of claim 10, wherein the average size is from 1 micron to 150 microns.

12. The sintered Ni—Ti-RE alloy of claim 1 comprising a density of at least 95% of theoretical density.

13. The sintered Ni—Ti-RE alloy of claim 12 wherein the density is least 98% of theoretical density.

14. The sintered Ni—Ti-RE alloy of claim 12 wherein the density is from 95% to 98% of theoretical density.

15. The sintered Ni—Ti-RE alloy of claim 1 exhibiting a hardness from 180 VHN to 550 VHN.

16. The sintered Ni—Ti-RE alloy of claim 1, wherein the matrix does not include a brittle network of the second phase.

17. The sintered Ni—Ti-RE alloy of claim 1 including a lower oxygen content and carbon content than starting powders due to purification during sintering.

* * * * *